US012428920B2

(12) United States Patent
Dave et al.

(10) Patent No.: US 12,428,920 B2
(45) Date of Patent: Sep. 30, 2025

(54) DOWNHOLE TOOL EMPLOYING A PRESSURE INTENSIFIER

(71) Applicant: Halliburton Energy Services, Inc., Houston, TX (US)

(72) Inventors: Jalpan Piyush Dave, Singapore (SG); Michael Linley Fripp, Singapore (SG); Shanu Thottungal Eldho, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/407,842

(22) Filed: Jan. 9, 2024

(65) Prior Publication Data

US 2025/0223882 A1 Jul. 10, 2025

(51) Int. Cl.
*E21B 23/04* (2006.01)
*E21B 23/06* (2006.01)
(Continued)

(52) U.S. Cl.
CPC ..... *E21B 23/0421* (2020.05); *E21B 23/06* (2013.01); *E21B 33/128* (2013.01); *E21B 34/10* (2013.01)

(58) Field of Classification Search
CPC ..... E21B 23/0416; E21B 23/042–0422; E21B 23/06; E21B 33/128; E21B 34/10
See application file for complete search history.

(56) References Cited

U.S. PATENT DOCUMENTS 4,545,433 A 10/1985 Wambaugh
4,653,588 A 3/1987 White
(Continued)

FOREIGN PATENT DOCUMENTS

BR 112021007440 A2 7/2021
GB 2552994 A 2/2018
(Continued)

OTHER PUBLICATIONS

Bartnicki, A., et al., "The Research of Hydraulic Pressure Intensifier for Use in Electric Drive System," IEEE Access, 2018, 6 Pages.
(Continued)

*Primary Examiner* — D. Andrews
(74) *Attorney, Agent, or Firm* — Scott Richardson; Parker Justiss, P.C.

(57) ABSTRACT

Provided is a downhole tool, a well system, and a method. The downhole tool, in one aspect, includes a mandrel, a sliding element positioned radially about the mandrel, and a pressure intensifier positioned radially about the mandrel and coupled to the sliding element. In one aspect, the pressure intensifier includes a first piston having a first pressure receiving end with a larger piston surface area ($A_{L1}$) and a first pressure output end with a smaller piston surface area ($A_S$). In one aspect, the pressure intensifier includes a second piston coupled to the first piston, the second piston having a second pressure receiving end with a larger piston surface area ($A_{L2}$). In one aspect, a fluid chamber is defined between the first pressure output end and the second pressure receiving end. In one aspect, the pressure intensifier is configured to move the sliding element with an applied force.

17 Claims, 46 Drawing Sheets

(51) Int. Cl.
*E21B 33/128* (2006.01)
*E21B 34/10* (2006.01)

(56) References Cited

U.S. PATENT DOCUMENTS

| | | | | |
|---|---|---|---|---|
| 5,429,036 | A | 7/1995 | Latos | |
| 5,893,413 | A * | 4/1999 | Lembcke | E21B 23/0411 166/321 |
| 6,073,708 | A | 6/2000 | Brown et al. | |
| 6,289,998 | B1 | 9/2001 | Krueger et al. | |
| 7,000,705 | B2 | 2/2006 | Buyers et al. | |
| 7,614,454 | B2 | 11/2009 | Buyers et al. | |
| 9,309,745 | B2 | 4/2016 | Patel | |
| 9,383,029 | B2 | 7/2016 | Scott | |
| 9,551,200 | B2 | 1/2017 | Read et al. | |
| 10,066,466 | B2 | 9/2018 | Radtke | |
| 10,132,135 | B2 | 11/2018 | Gaude | |
| 2005/0011678 | A1 | 1/2005 | Akinlade et al. | |
| 2010/0243234 | A1 | 9/2010 | Saltel | |
| 2011/0232474 | A1 | 9/2011 | Geiger | |
| 2014/0190708 | A1 | 7/2014 | Hallundbaek | |
| 2014/0216755 | A1 | 8/2014 | Hallundaek et al. | |
| 2015/0315871 | A1* | 11/2015 | Fripp | E21B 34/063 166/321 |
| 2016/0160850 | A1 | 6/2016 | Mcnichol | |
| 2016/0177658 | A1* | 6/2016 | Lee | E21B 23/04 166/305.1 |
| 2017/0321515 | A1 | 11/2017 | Staehr | |
| 2017/0343019 | A1 | 11/2017 | Thomson et al. | |
| 2018/0080303 | A1* | 3/2018 | Radtke | E21B 33/1212 |
| 2021/0047893 | A1 | 2/2021 | Hrupp et al. | |
| 2021/0363844 | A1* | 11/2021 | Roane | E21B 23/06 |
| 2022/0090457 | A1 | 3/2022 | Tanguy et al. | |

FOREIGN PATENT DOCUMENTS

| | | | |
|---|---|---|---|
| WO | 999035365 | | 7/1999 |
| WO | 2016051180 | A1 | 4/2016 |
| WO | 2018033708 | | 2/2018 |

OTHER PUBLICATIONS

Halliburton Energy Services, Inc, "Endurance Hydraulic Screen®", YouTube video, posted on Halliburton's channel and available at https://www.youtube.com/watch?v=hKkSMAOm8A4, 2021, 1 page (website screenshot submitted), 2021, 1 page.

Saltel Industries, "Expandable Steel Packer for Improving Primary Cementing", YouTube video, posted onSaltel's channel and available at https://www.youtube.com/watch?v=OY5pbjnh-iY, Apr. 19, 2019, 1 page (website screenshot submitted), 2019, 1 page.

* cited by examiner

DOWNHOLE TOOL EMPLOYING A PRESSURE INTENSIFIER

BACKGROUND

A typical downhole tool (e.g., packer, bridge plug, frac plug, anchor, etc.) generally has one or more radially extending elements that are employed to provide a fluid-tight seal or anchor radially between a mandrel of the downhole tool, and the casing or wellbore into which the downhole tool is disposed. Such a downhole tool is commonly conveyed into a subterranean wellbore suspended from tubing extending to the earth's surface.

To prevent damage to the radially extending elements of the downhole tool while the downhole tool is being conveyed into the wellbore, the radially extending elements may be carried on the mandrel in a retracted or uncompressed state, in which they are radially inwardly spaced apart from the casing. When the downhole tool is set, the radially extending elements radially expand, thereby providing the fluid-tight seal or anchor between the mandrel and the casing and/or wellbore. In certain embodiments, the radially extending elements are axially compressed between element retainers that straddle them, which in turn radially expand the radially extending elements.

BRIEF DESCRIPTION

Reference is now made to the following descriptions taken in conjunction with the accompanying drawings, in which.

Figure 5A:
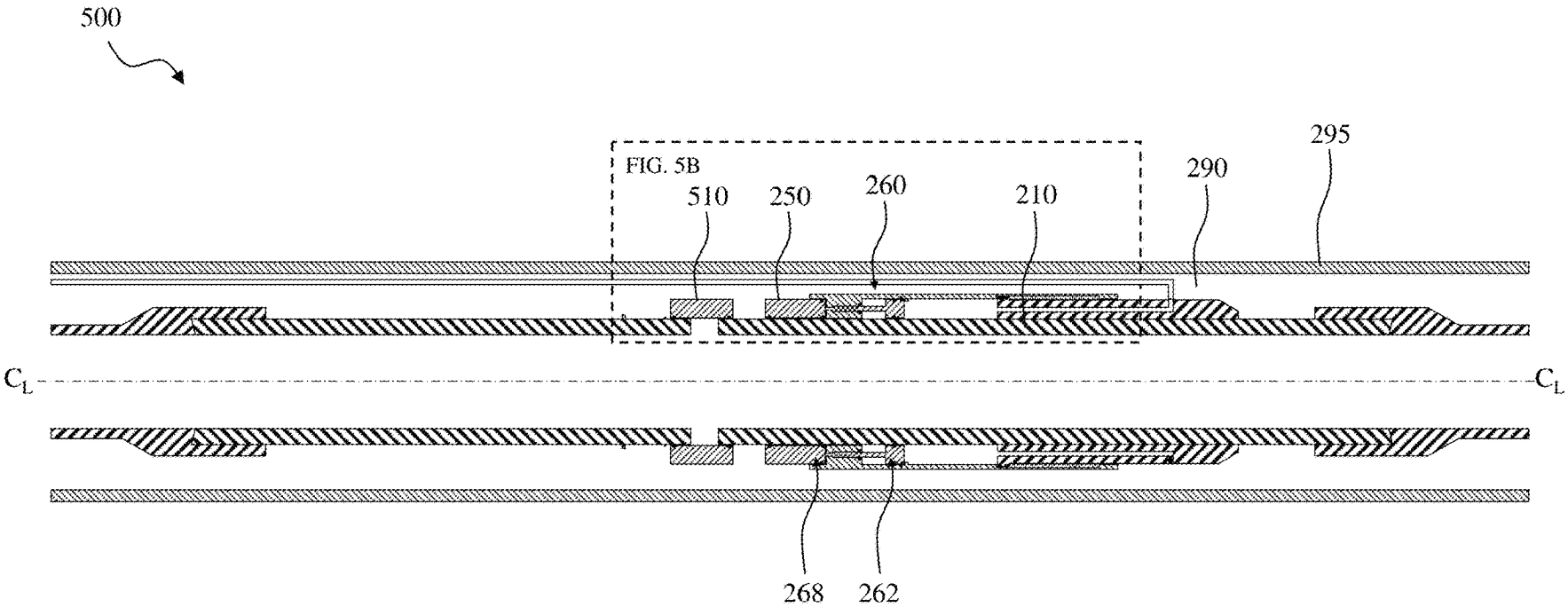
Figure 5B:
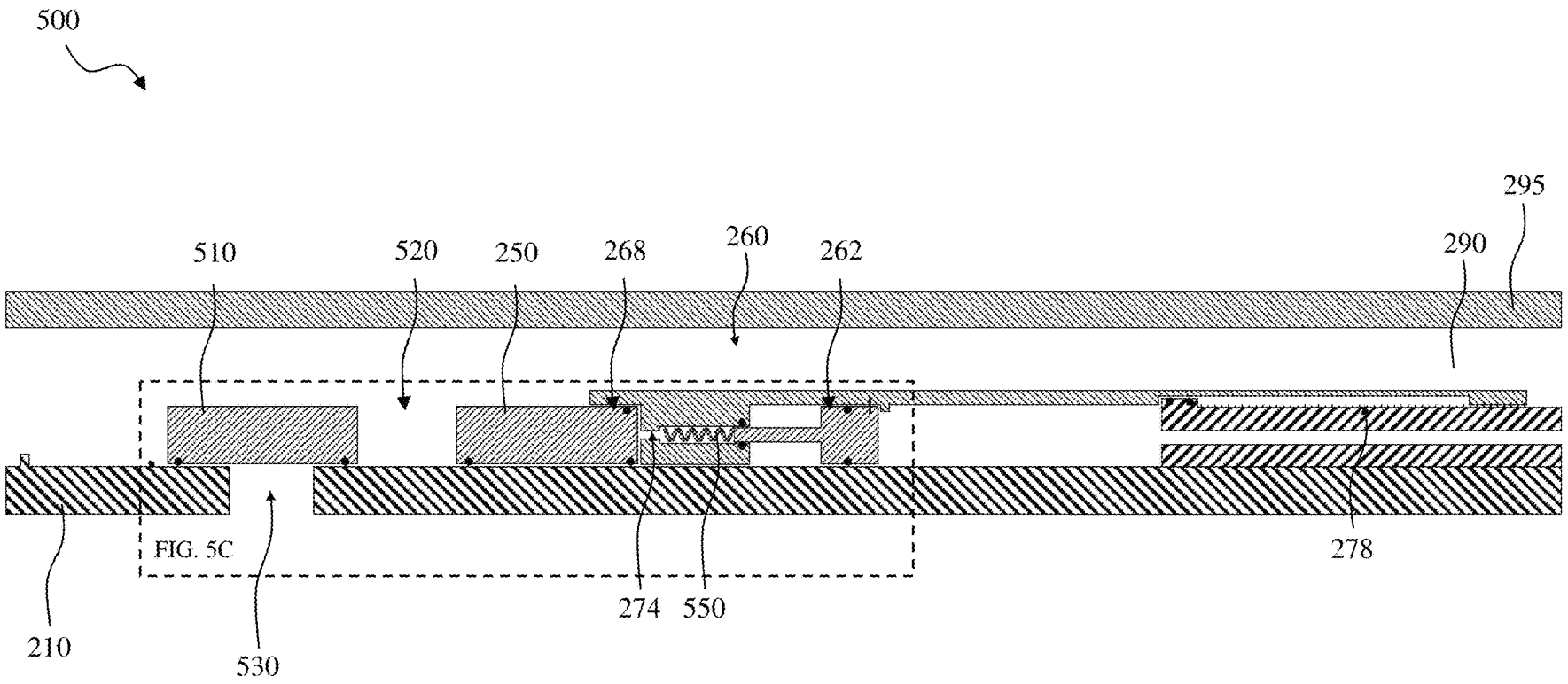
Figure 5C:
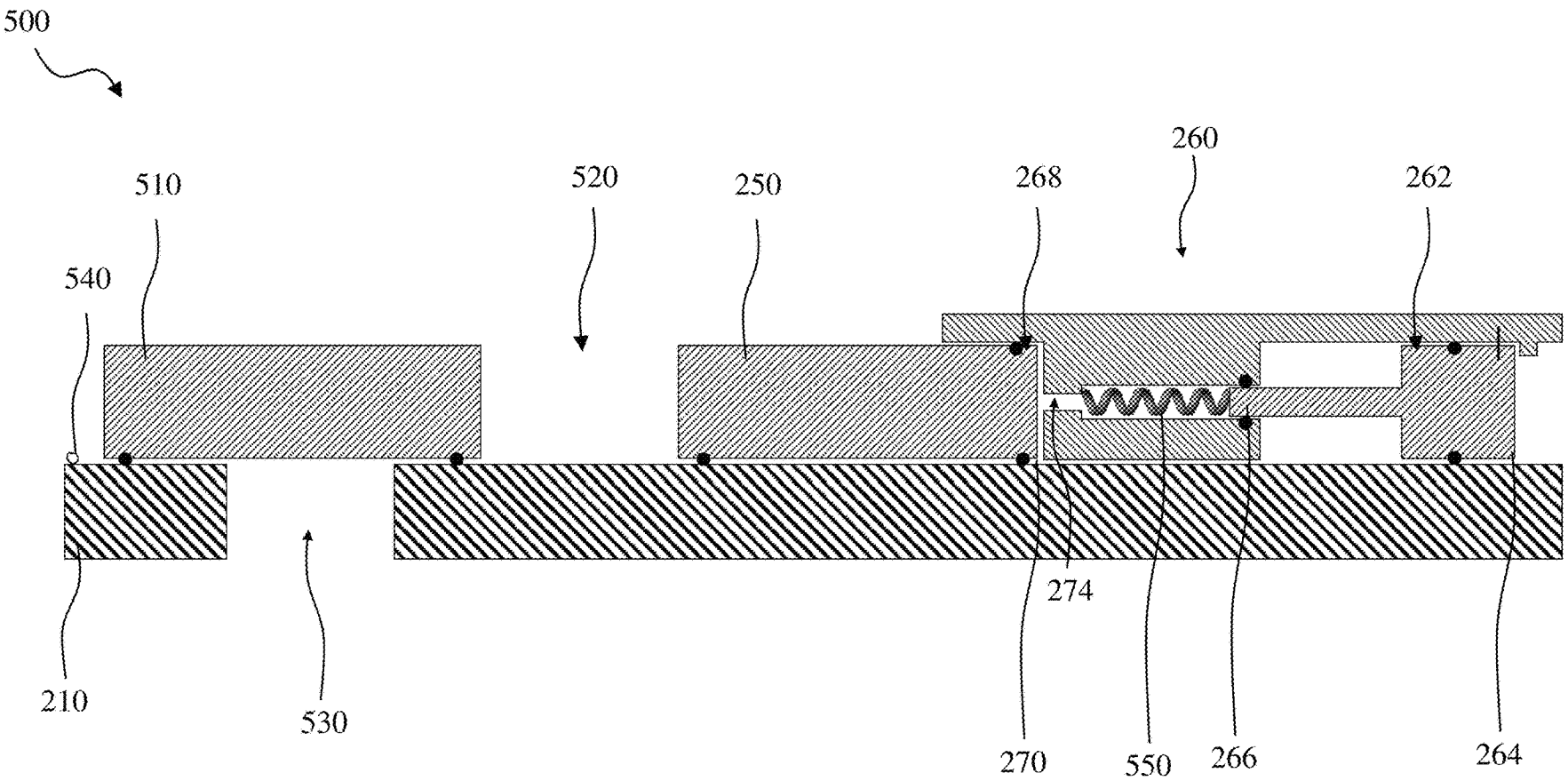
Figure 5D:
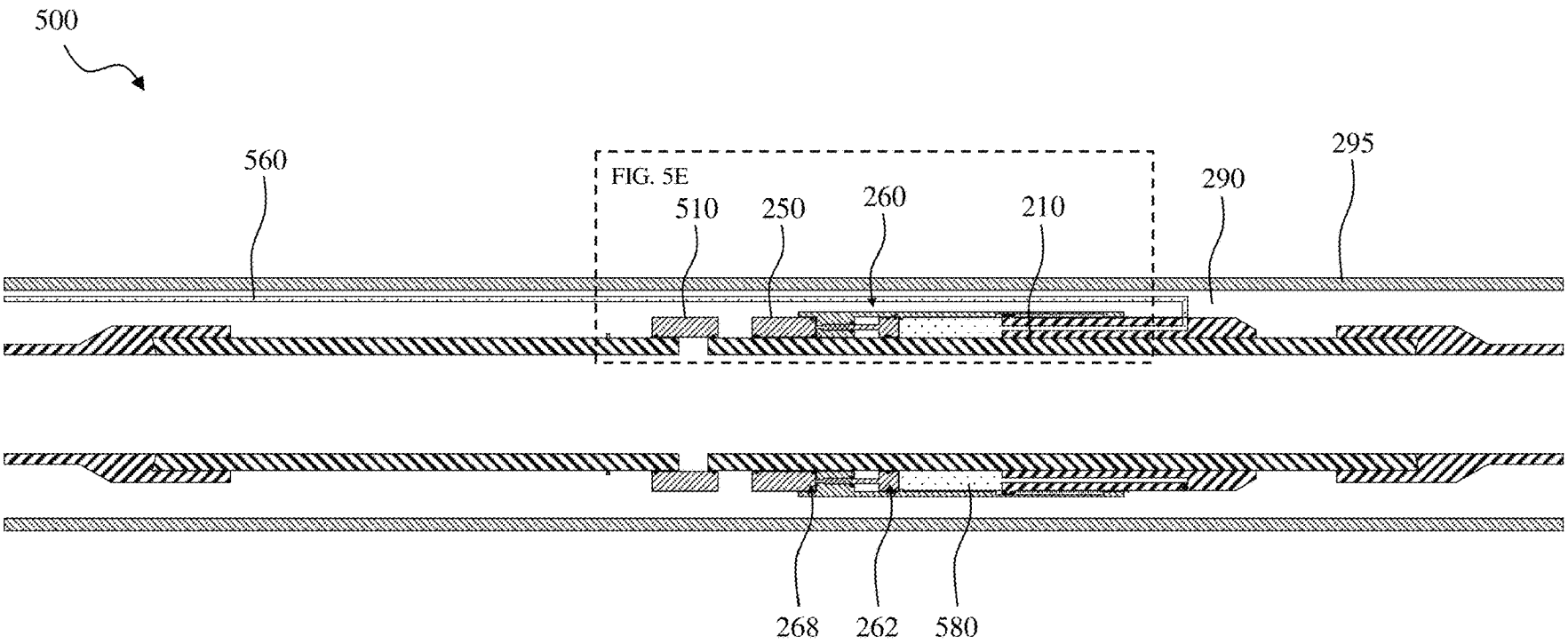
Figure 5E:
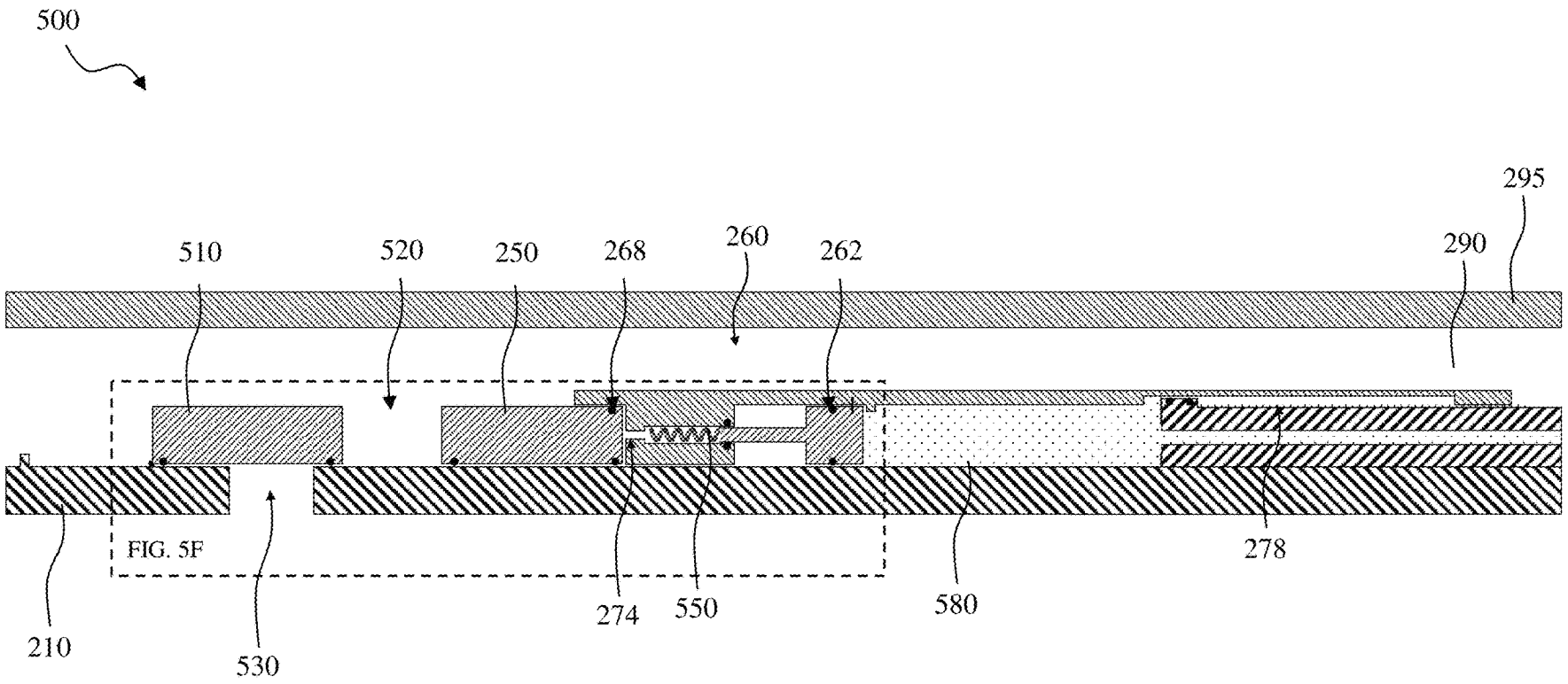
Figure 5F:
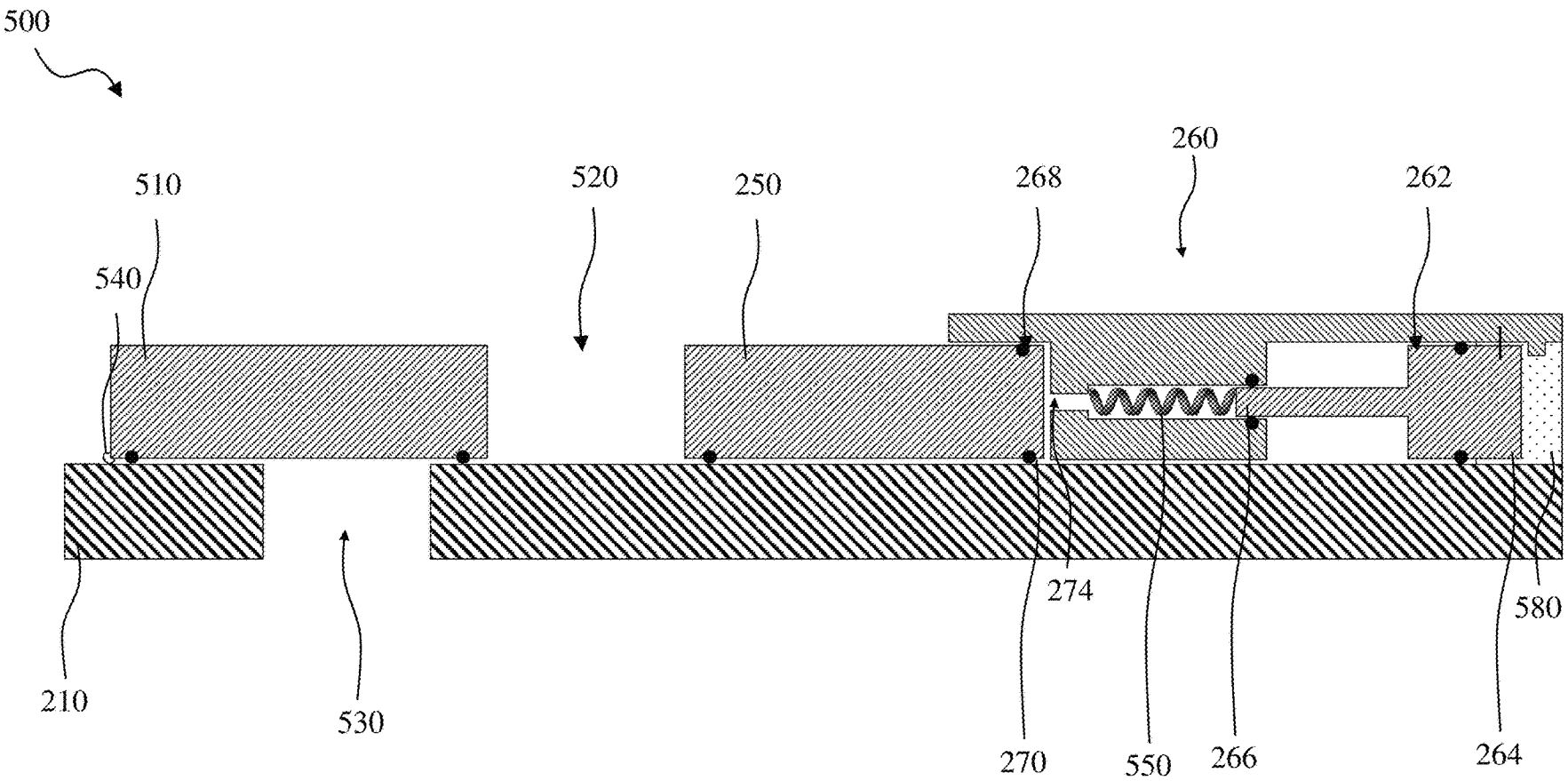
Figure 5G:
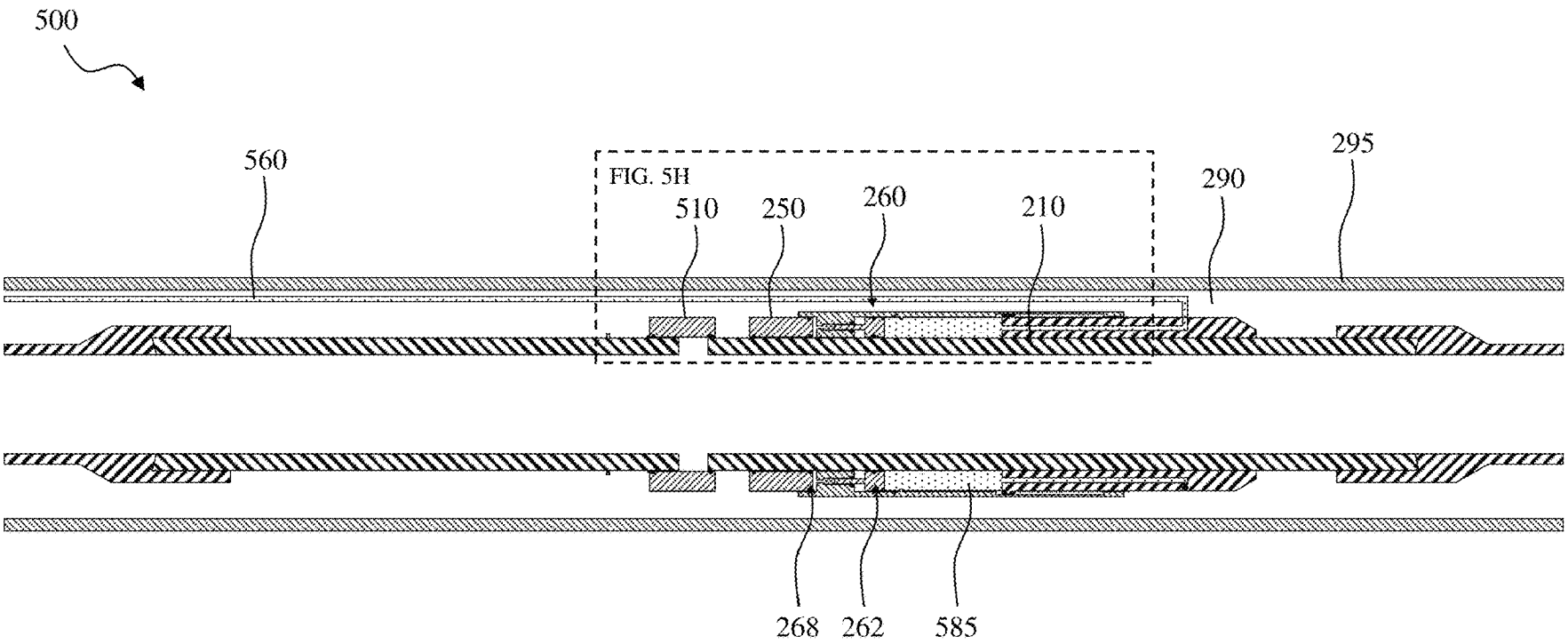
Figure 5H:
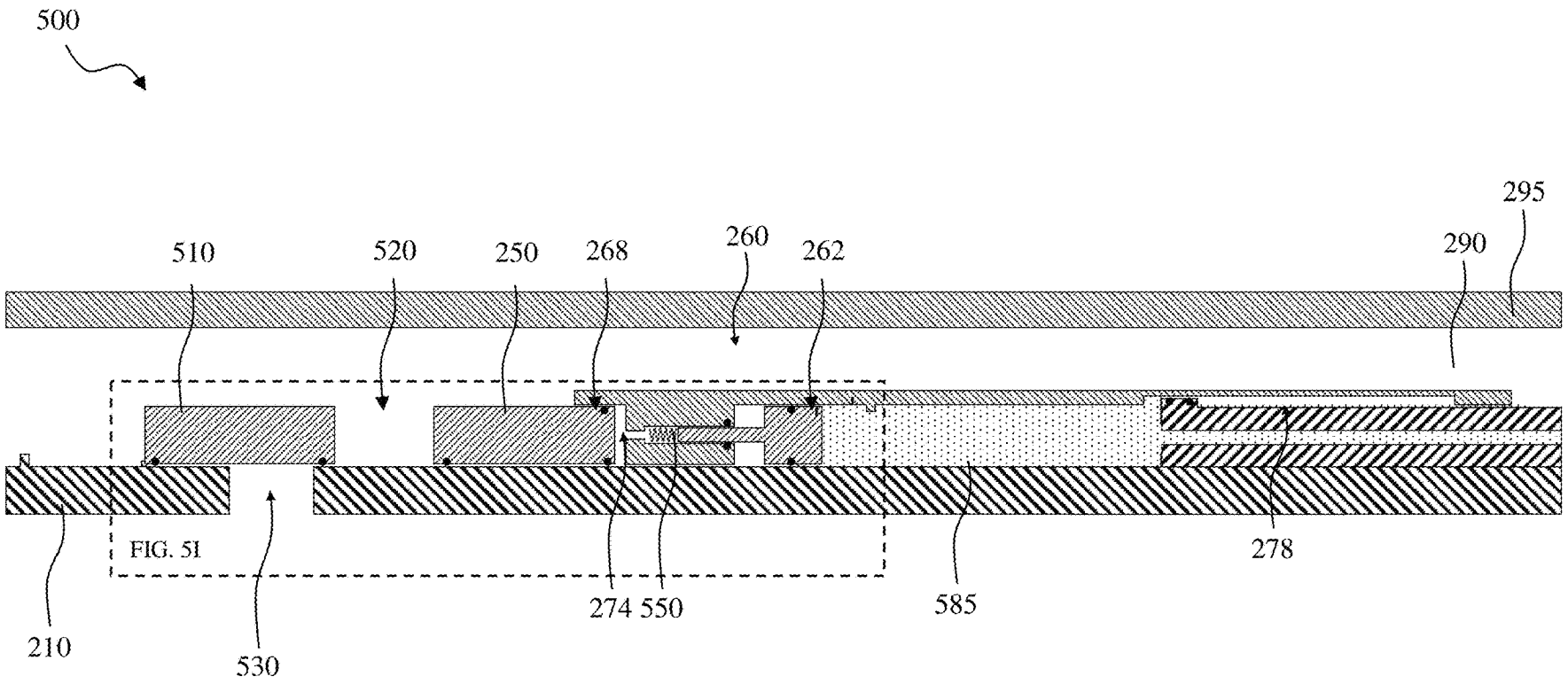
Figure 5I:
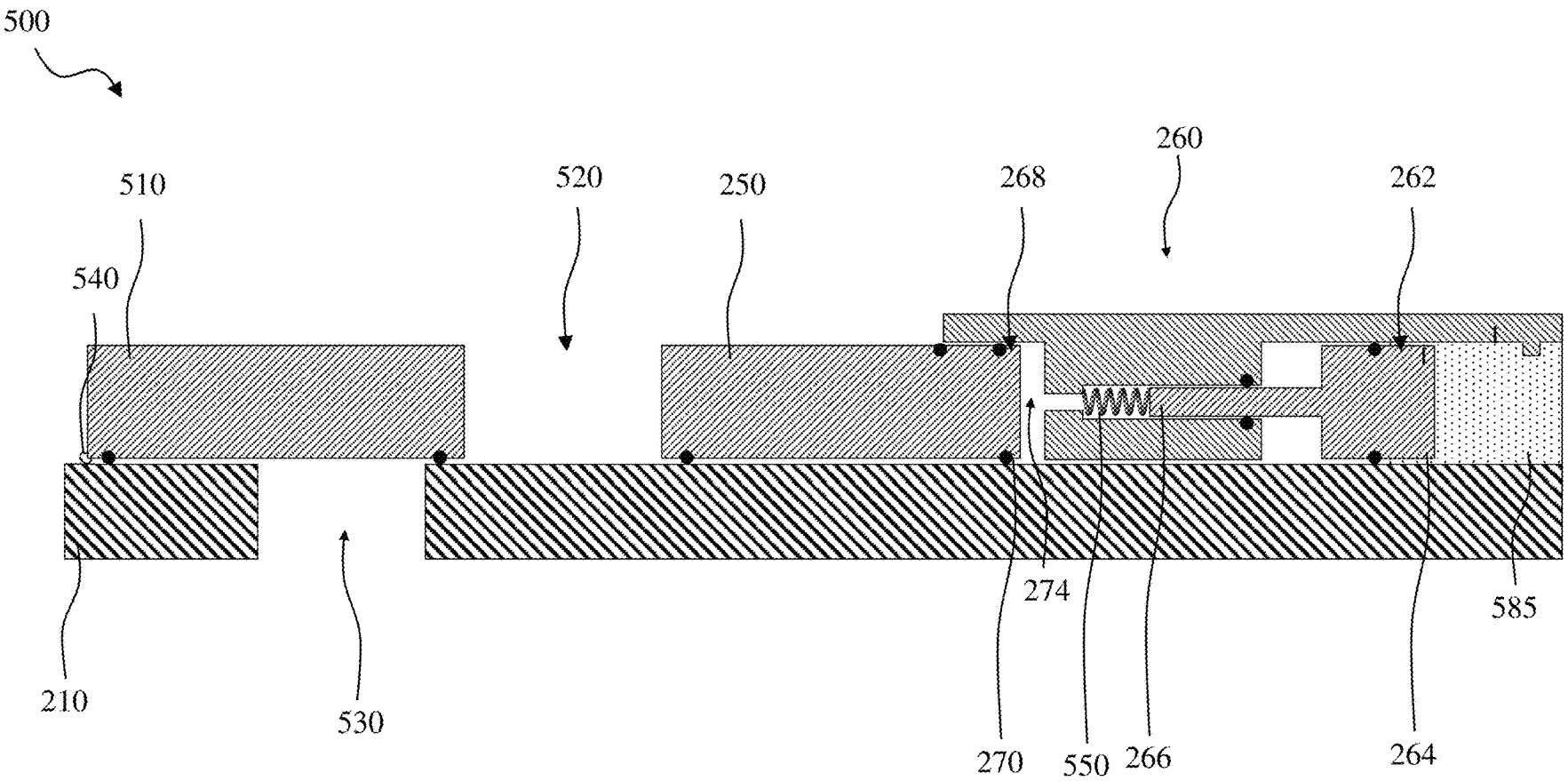
Figure 5J:
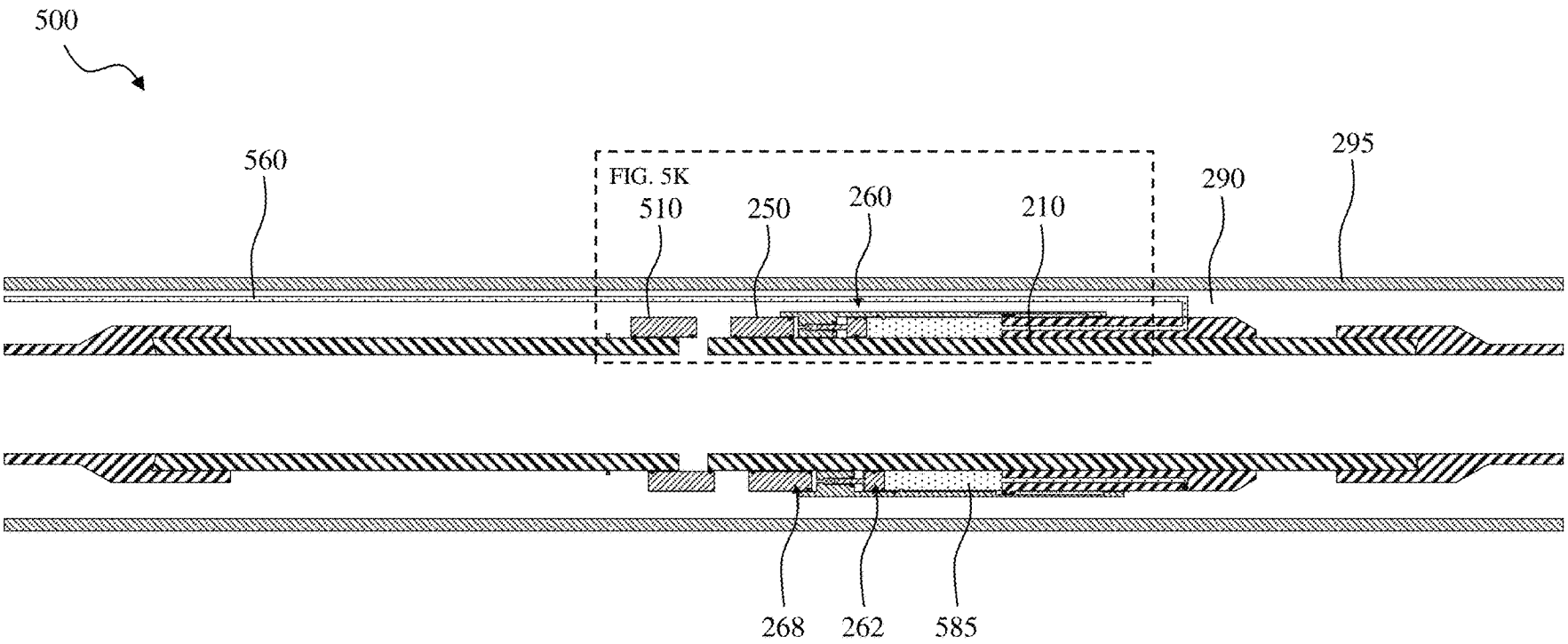
Figure 5K:
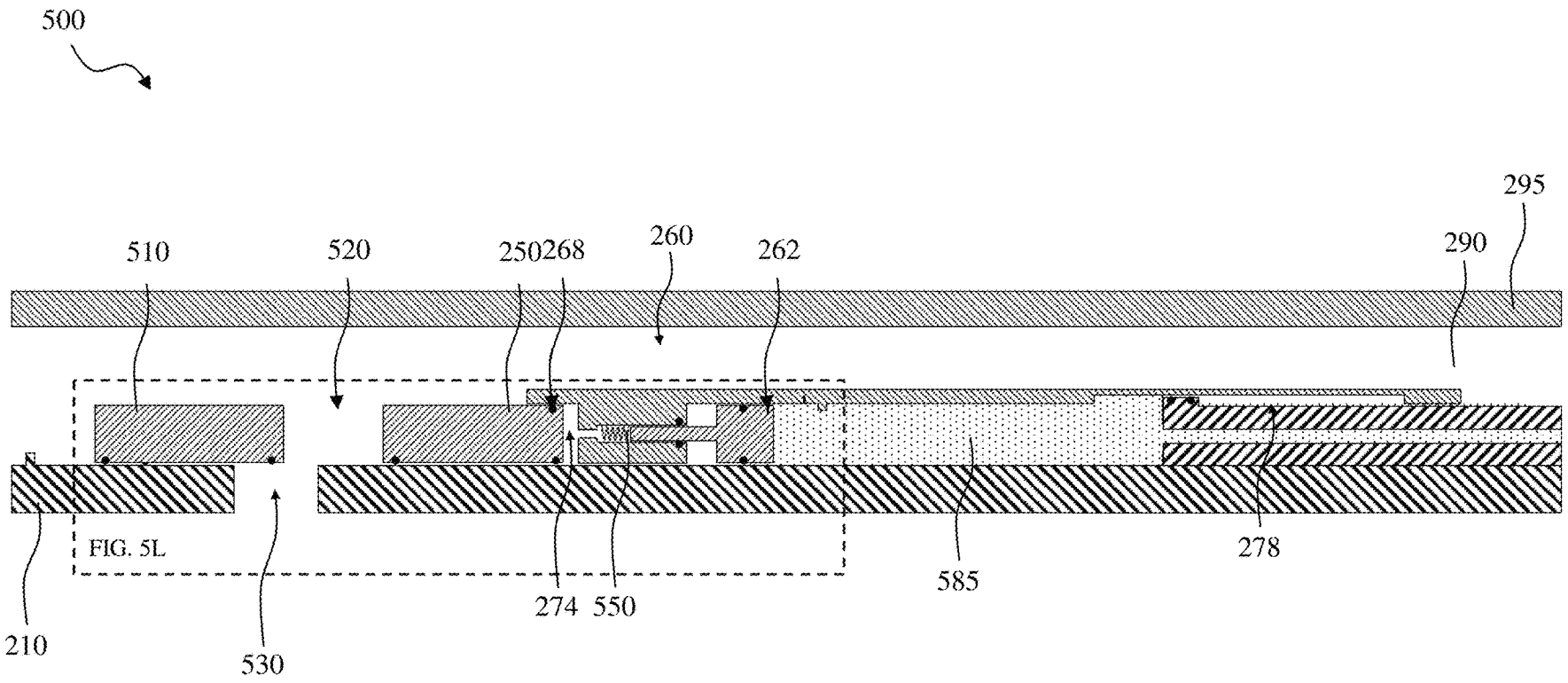
Figure 5L:
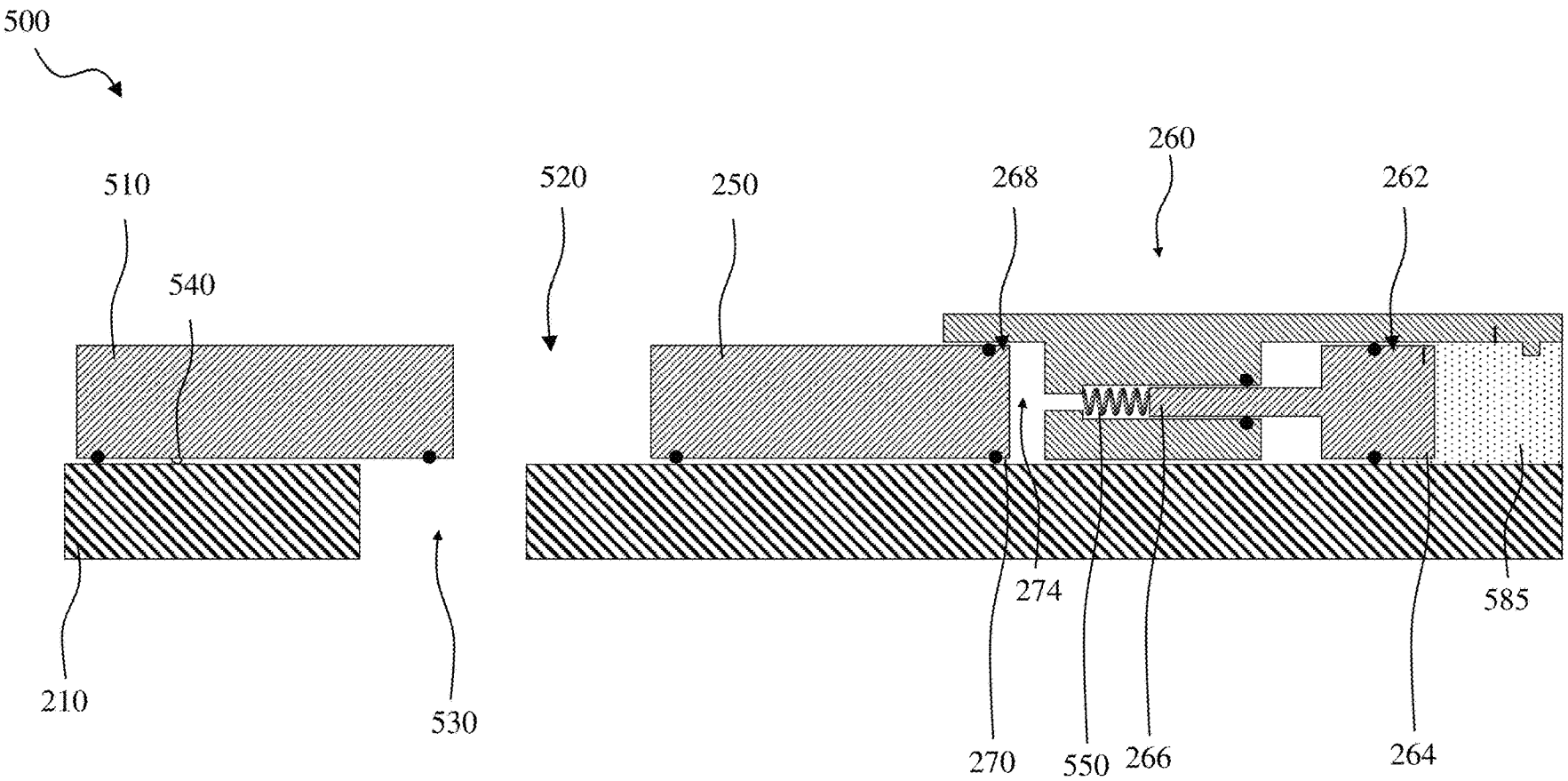
Figure 5M:
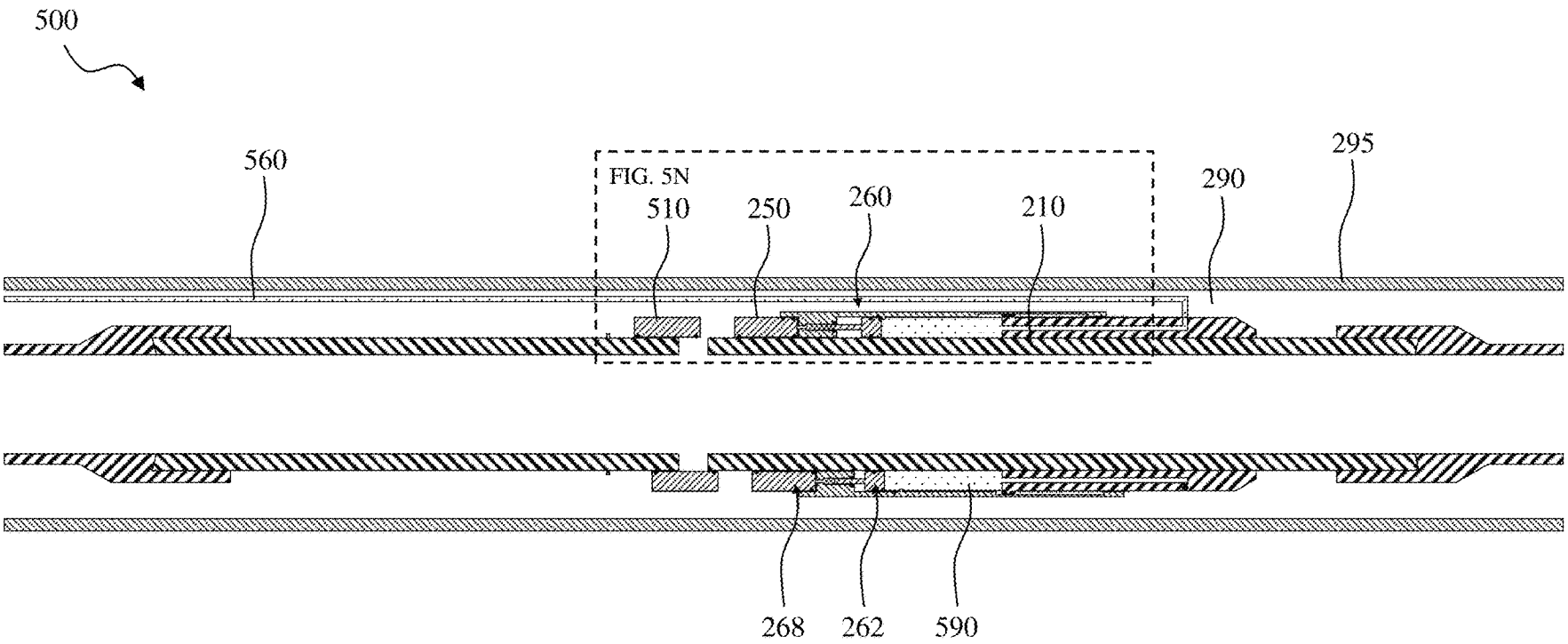
Figure 5N:
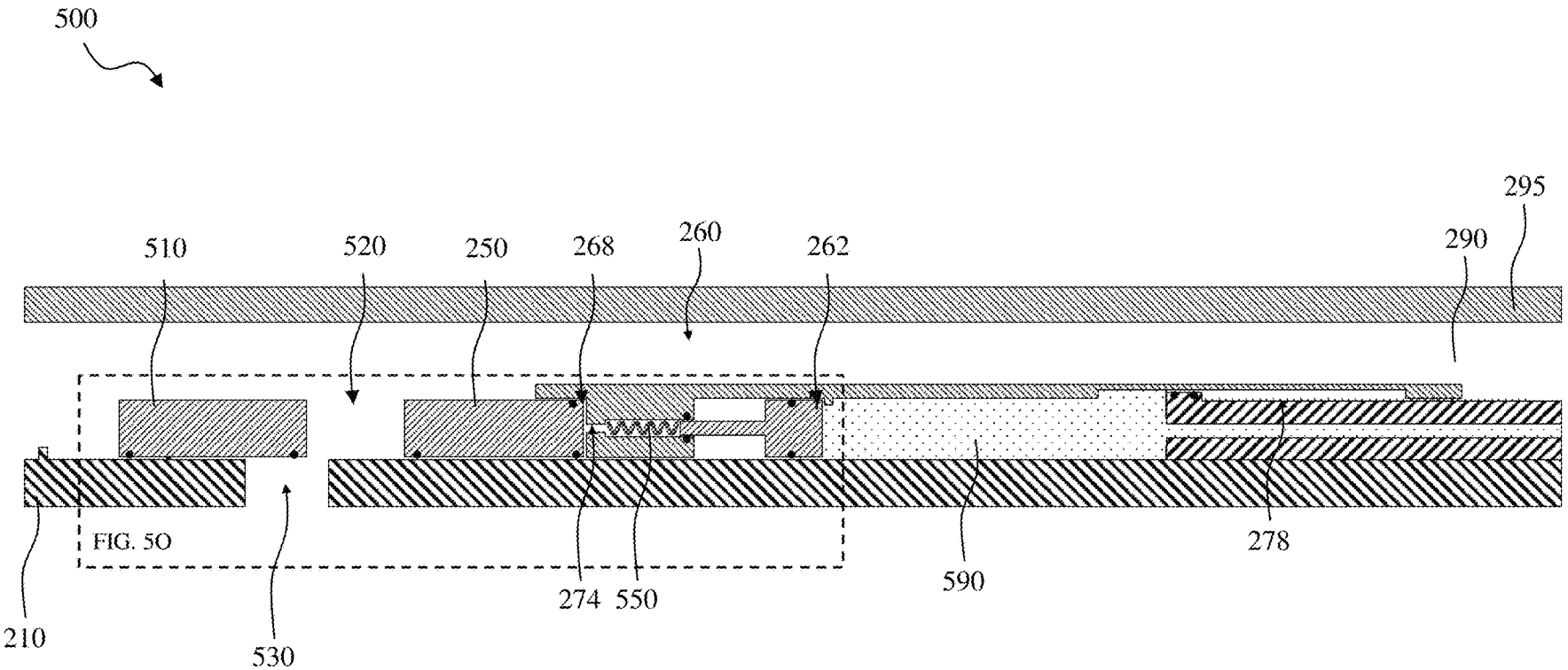
Figure 5O:
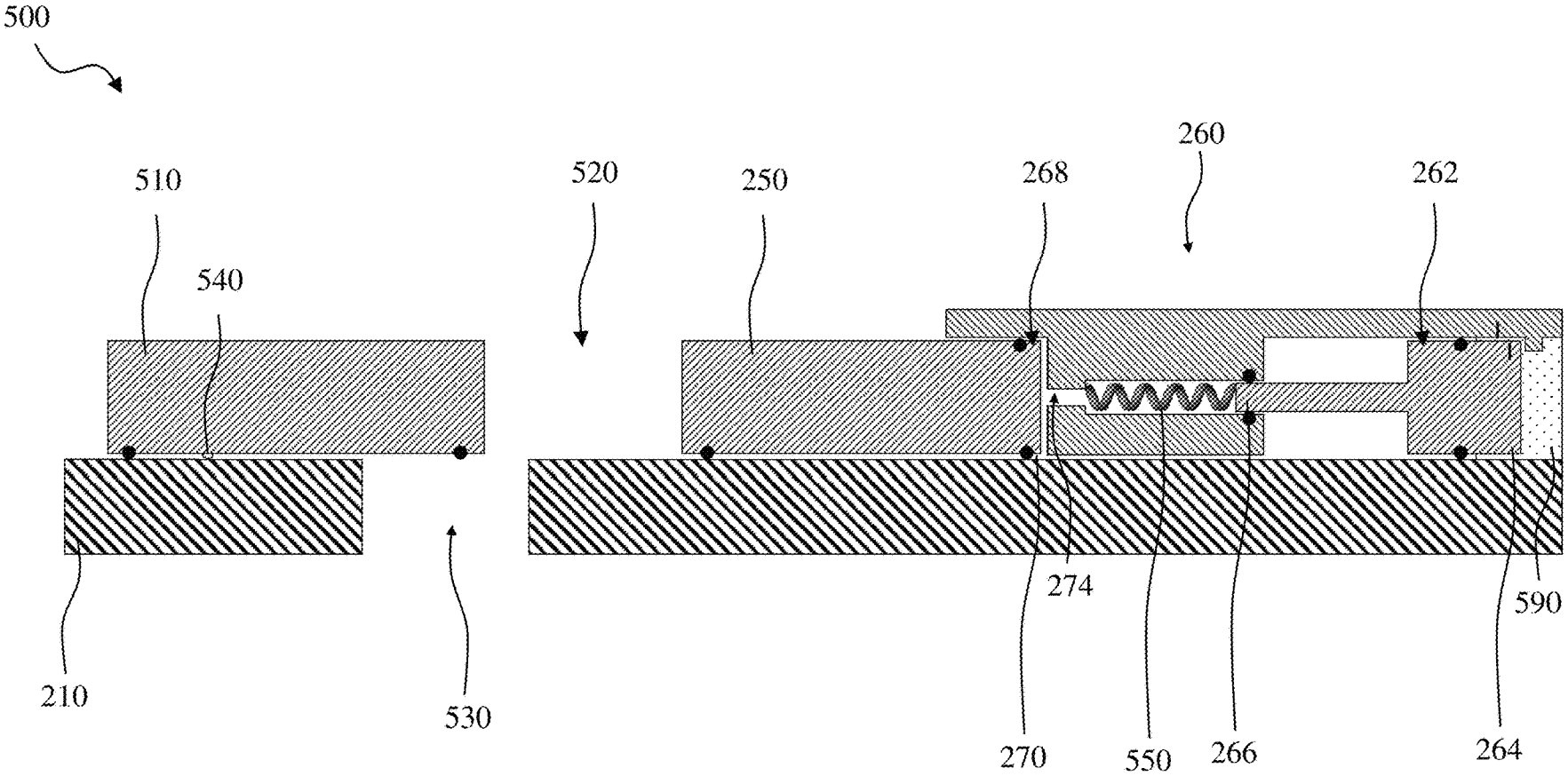
Figure 5P:
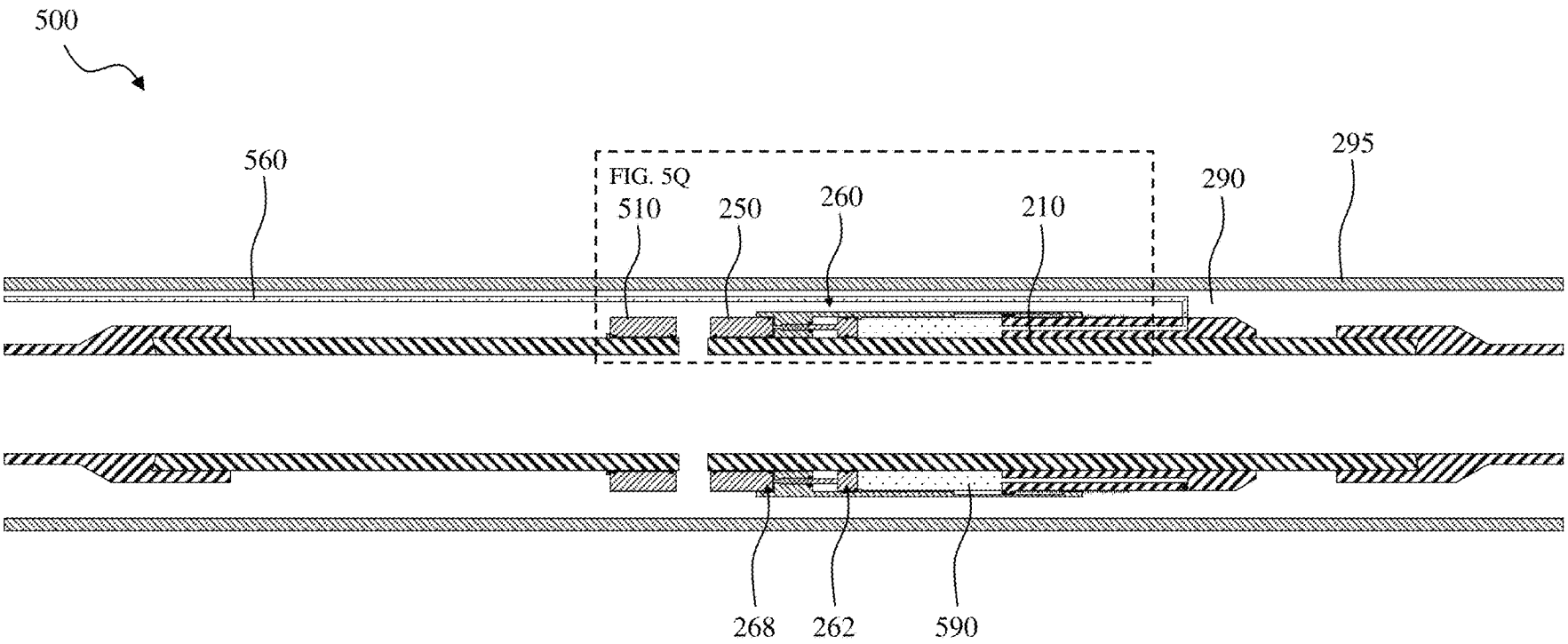
Figure 5Q:
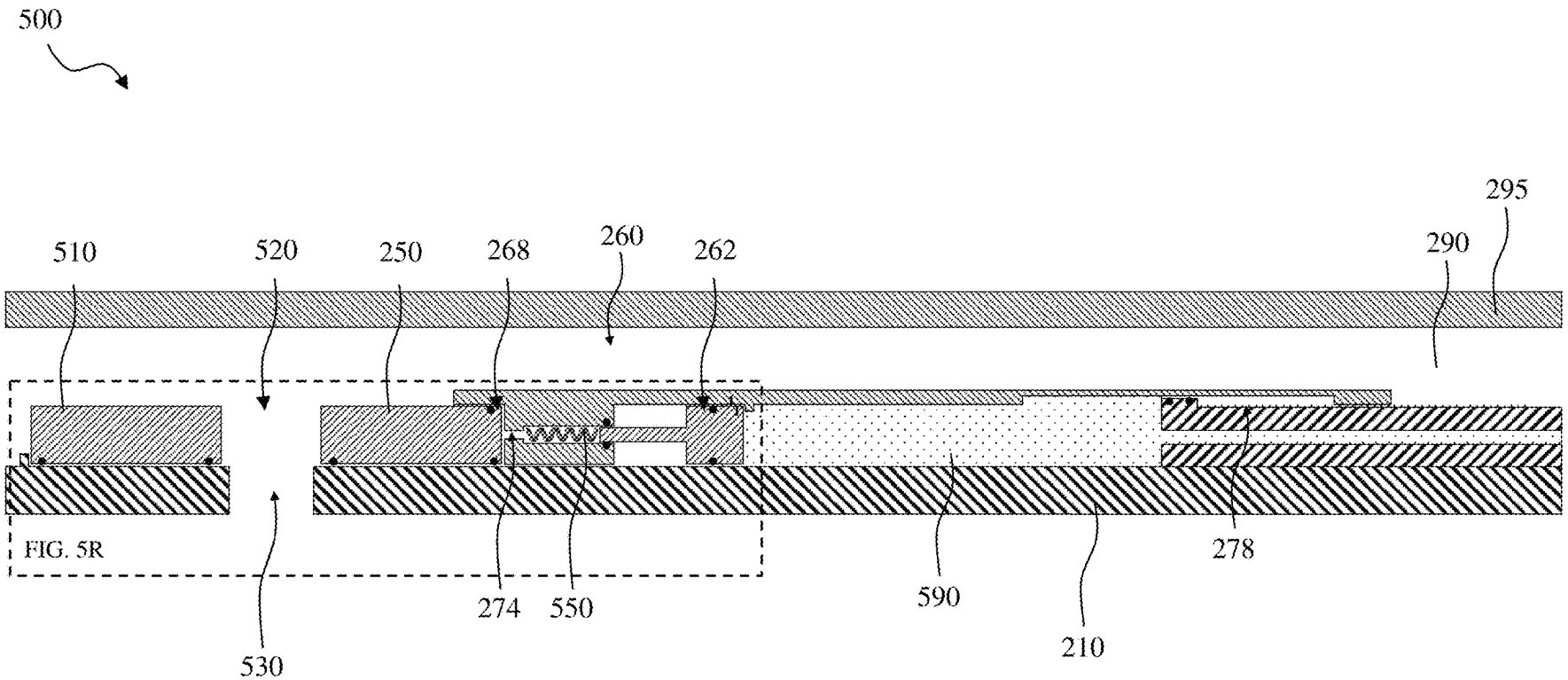
Figure 5R:
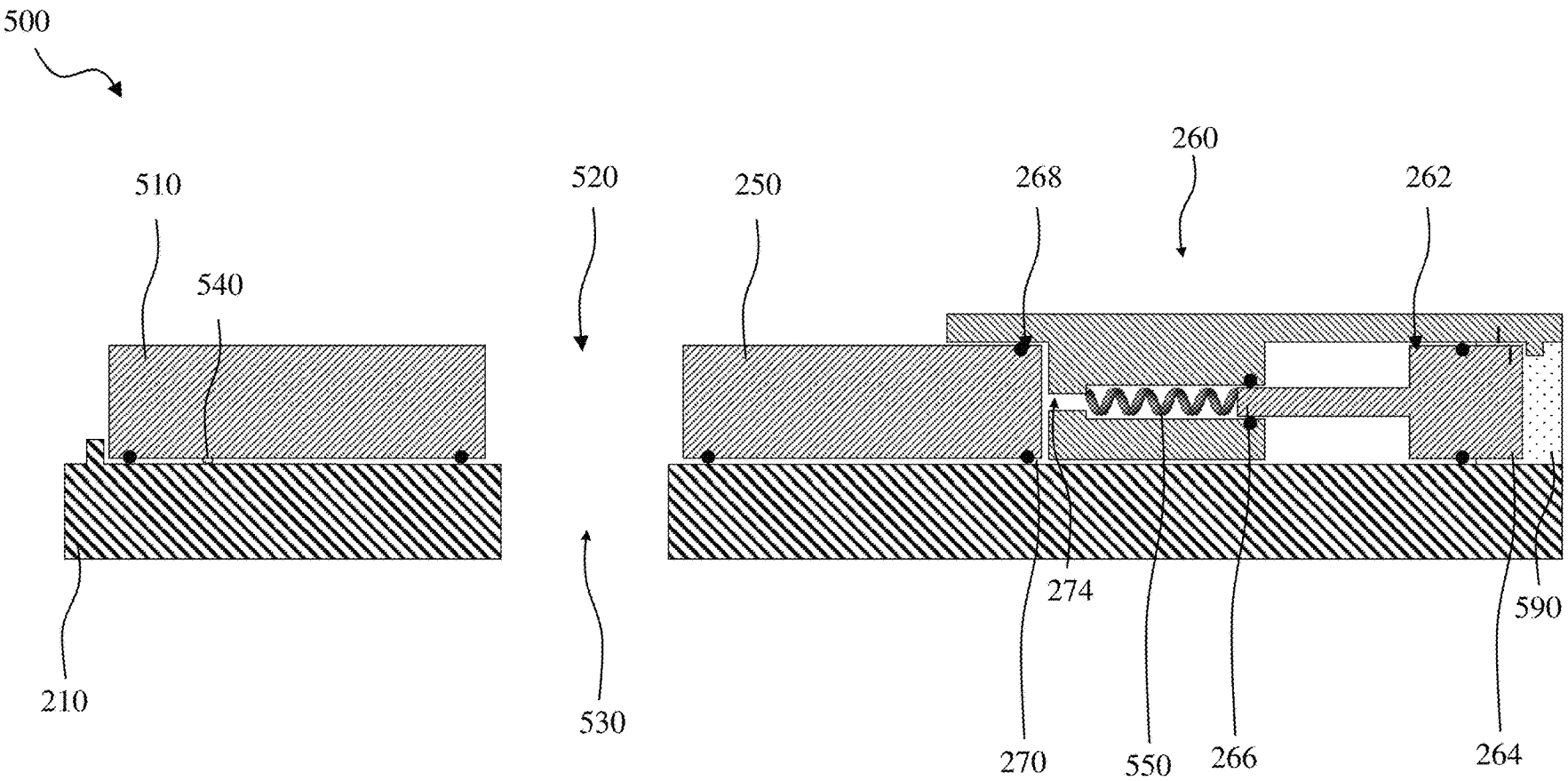

FIGS. 4A through 4I illustrate different cross-sectional views of various deployment states of a downhole tool designed, manufactured and/or operated according to one or more alternative embodiments of the disclosure; and FIGS. 5A through 5R illustrate different cross-sectional views of various deployment states of a downhole tool designed, manufactured and/or operated according to one or more alternative embodiments of the disclosure.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Sliding elements are traditionally a critical part of a downhole tool, such as a sealing assembly, anchoring assembly, and/or valve assembly, among others. The present disclosure, however, has recognized that when hydraulically moving the sliding elements of such downhole tools (e.g., setting the radially extending elements of a sealing assembly or anchoring assembly), the hydraulic setting force can be a design limitation. In at least one scenario, surface equipment coupled to the sliding element is limited in an amount of hydraulic setting force it can provide, and the limited amount of setting force is insufficient to fully deploy the sliding element (e.g., sealing assembly, anchoring assembly, or valve assembly). In at least one other scenario, the amount of hydraulic setting force provided downhole is intentionally reduced, so as to not prematurely shear other wellbore features (e.g., shear features, collets, etc. located within the wellbore), such as might be the case if too high of a setting pressure is applied to deploy the sliding element (e.g., sealing assembly, anchoring assembly, or valve assembly).

Understanding these concerns, the industry has moved to employing a plurality (e.g., two or more, three or more, etc.) of setting pistons connected in series, for example to take the otherwise insufficient hydraulic setting force provided downhole and locally increase it to a higher hydraulic setting force that might be required to fully deploy the sliding elements (e.g., sealing assembly, anchoring assembly, or valve assembly). Take, for example, a triple piston design, wherein each piston has a 5 sq. in. surface area, for a total surface area of 15 sq. in. Applying 400 psi of pressure to the triple piston design would result in 6,000 lbs. of force (e.g., 400 psi×15 sq. in.) impart upon the sliding element. When the pressure impart on the triple piston design is increased to 2,500 psi, 37,500 lbs. of force (2,500 psi×15 sq. in.) would be imparted upon the sliding element. Unfortunately, such a design requires that each piston of the triple piston design travel its full length to move the sliding element its full stroke length. Thus, if it were necessary to move the sliding element (e.g., stroke the sealing assembly or anchoring assembly) a given total stroke length distance (e.g., say 13 inches), 3 times that distance (e.g., say 39 inches) of combined piston movement would be required to do so.

Given the foregoing, the present disclosure proposes to combine a traditional hydraulic setting mechanism and a pressure intensifier to achieve higher localized pressures (e.g., for a given applied pressure) than was traditionally achievable. A pressure intensifier, as disclosed herein, employs a first piston having different surface areas at a pressure receiving end and a pressure output end thereof, connected to a second piston having a second larger surface area. For example, the pressure receiving end of the first piston might have a larger surface area ($A_{L1}$) and the pressure output end of the first piston might have a smaller surface area ($A_S$). The pressure output end of the first piston having the smaller surface area ($A_S$) could then be coupled to the second piston having a second larger surface area ($A_{L2}$), for example via an incompressible fluid.

Take, for example, a pressure intensifier having a first piston having a larger surface area ($A_{L1}$) of 5 sq. in. at its pressure receiving end and a smaller surface area ($A_S$) of 1 sq. in. at its pressure output end, and a second piston having a second larger surface area ($A_{L2}$) of 5 sq. in. at its pressure receiving end. In this embodiment, the second piston would be coupled to the pressure output end of the first piston via an incompressible fluid. In this scenario, assuming the pressure intensifier were activated at all times, if one were to initially apply 240 psi to the pressure receiving end of the first piston, 1,200 lbs. of force (e.g., 240 psi×5 sq. in.) would be generated at the output end of the first piston. Given the output end of the first piston has the smaller surface area ($A_S$) of 1 sq. in., the 1,200 lbs. of force would translate into 1,200 psi (e.g., 1,200 lbs. of force/1 sq. in.) at the output end of the first piston. This 1,200 psi would then act upon the incompressible fluid, and thus the second piston having the second larger surface area ($A_{L2}$) of 5 sq. in. What would result is 6,000 lbs. of force (e.g., 1,200 psi×5 sq. in.) being translated to the second piston, and ultimately the sliding element (e.g., sealing assembly, anchoring assembly, or valve assembly) during this initial phase. In at least one embodiment, the lower pressure might be used for a majority of the total setting stroke of the sliding element.

However, if one were to subsequently (e.g., selectively) apply 1,500 psi to the pressure receiving end of the first piston, 7,500 lbs. of force (e.g., 1,500 psi×5 sq. in.) would be generated at the output end of the first piston. Given the output end of the first piston has the smaller surface area ($A_S$) of 1 sq. in., the 7,500 lbs. of force would translate into 7,500 psi (e.g., 7,500 lbs. of force/1 sq. in.) at the output end of the first piston. This 7,500 psi would then act upon the incompressible fluid, and thus the second piston having the larger surface area ($A_{L2}$) of 5 sq. in. What would result is 37,500 lbs. of force (e.g., 7,500 psi×5 sq. in.) being translated to the second piston, and ultimately the sliding element (e.g., sealing assembly, anchoring assembly, or valve assembly) during this subsequent phase. In at least one embodiment, this higher pressure might be used for a minority of the total setting stroke of the sliding element.

In accordance with this embodiment, the use of the pressure intensifier would allow the user thereof to advantageously achieve the same increased output force (e.g., 37,500 lbs. of force) using a lower fluid pressure (e.g., 1,500 psi as compared to 2,500 psi), as compared to the triple piston design. Interestingly, the tool length and total stroke length of the sliding element would remain the same as the triple piston design.

Given the foregoing, the present disclosure further proposes using a combination of the traditional hydraulic setting mechanism in conjunction with a selectively engageable pressure intensifier. The selectively engageable pressure intensifier, in at least one embodiment, selectively boosts the setting force of the sealing assembly, for example toward an end of the total setting stroke. In at least one embodiment, the traditional setting mechanism provides a lower setting force (e.g., based upon applying an initial fluid pressure) over a portion of the total setting stroke (e.g., when the pressure intensifier is deactivated), wherein when activated the pressure intensifier provides an increased setting force (e.g., based upon an increased subsequent fluid pressure) over another portion (e.g., a remaining portion) of the total setting stroke. For example, the traditional setting mechanism could be used to provide the setting force over a majority of the total setting stroke (e.g., greater than 50%, if not equal to or greater than 55%, if not equal to or greater than 60%, if not equal to or greater than 65%, if not equal to or greater than 70%, if not equal to or greater than 75%, if not equal to or greater than 80%, if not equal to or greater than 85%, if not equal to or greater than 90%, if not equal to or greater than 95%) while the pressure intensifier could be used to provide the increased subsequent setting force over a minority of the total setting stroke (e.g., less than 50%, if not equal to or less than 45%, if not equal to or less than 40%, if not equal to or less than 35%, if not equal to or less than 30%, if not equal to or less than 25%, if not equal to or less than 20%, if not equal to or less than 15%, if not equal to or less than 10%, if not equal to or less than 5%).

In accordance with at least one embodiment, the pressure intensifier only activates (e.g., is engaged) to provide the increased setting force near the end of the total setting stroke, for example where the increased setting force is actually needed to fully deploy the sliding element (e.g., fully engage the sealing assembly or anchoring assembly with the outer tubular), but otherwise is deactivated (e.g., disengaged). Accordingly, the lower setting force may be used when the sliding element (e.g., sealing assembly, anchoring assembly, or valve assembly) is simply sliding into place, and the increased setting force be used when the sliding element (e.g., sealing assembly, anchoring assembly, or valve assembly) is engaging another feature (e.g., is just about to radially engage the tubular). Not only does the pressure intensifier allow an overall lower applied pressure to achieve the same increased setting force, for example as compared to the triple piston design discussed above, employing the pressure intensifier that only activates near the end of the stroke can do so using a much smaller overall tool length for a given total setting stroke, in relation to the triple piston design or the pressure intensifier design wherein it is always activated.

Take again, for example, a selectively engageable pressure intensifier having the first piston having the larger surface area ($A_{L1}$) of 5 sq. in. at its pressure receiving end and the smaller surface area ($A_S$) of 1 sq. in. at its pressure output end, and the second piston having the second larger surface area ($A_{L2}$) of 5 sq. in. at its pressure receiving end. In this embodiment, when the selectively engageable pressure intensifier is deactivated, the first and second pistons are physically coupled to one another, such that when the first piston moves a fixed distance the second piston also moves the same fixed distance (e.g., for an initial part of the total setting stroke). However, when the selectively engageable pressure intensifier is activated, the first piston is fluidly coupled to the second piston via the incompressible fluid, such that when the first piston moves a fixed distance the second piston moves a lesser distance (e.g., for a remaining part of the total setting stroke).

Given this scenario, and assuming that the selectively engageable pressure intensifier is deactivated, if one were to initially apply 1,200 psi to the pressure receiving end of the first piston, 6,000 lbs. of force (e.g., 1,200 psi×5 sq. in.) would be generated at the output end of the first piston. As the first piston and the second piston are physically coupled to one another (e.g., regardless of the fact that the output end of the first piston has the smaller surface area ($A_S$) of 1 sq. in.), the 6,000 lbs. of force would translate directly to the second piston and sliding element, and ultimately the sealing assembly, anchoring assembly or valve assembly during this initial phase.

However, if one were to increase the pressure impart upon the pressure receiving end of the first piston to a value that would break the physical connection between the first piston and the second piston (e.g., and activate the selectively engageable pressure intensifier), and thus allow the first piston and second piston to be fluidly coupled to one another, the benefits of the pressure intensifier could be realized. Say for example if the pressure were increased to 1,500 psi (e.g., enough to activate the selectively engageable pressure intensifier), 7,500 lbs. of force (e.g., 1,500 psi×5 sq. in.) would be generated at the output end of the first piston. Given the output end of the first piston has the smaller surface area ($A_S$) of 1 sq. in., the 7,500 lbs. of force would translate into 7,500 psi (e.g., 7,500 lbs. of force/1 sq. in.=7,500 psi) at the output end of the first piston. This 7,500 psi would then act upon the incompressible fluid, and thus the second piston and/or sleeve having a larger surface area ($A_{L2}$) of 5 sq. in., resulting in 37,500 lbs. of force (e.g., 7,500 psi×5 sq. in.) translated to the second piston and sliding element, and ultimately the sealing assembly, anchoring assembly or valve assembly during this subsequent phase.

Accordingly, the use of the selectively engageable pressure intensifier would allow the user thereof to advantageously achieve the same increased output force (e.g., 37,500 lbs. of force) using a lower fluid pressure (e.g., 1,500 psi as compared to 2,500 psi), as compared to the triple piston design. However, the use of the selectively engageable pressure intensifier would also allow for a shorter tool length for a given total setting stroke (e.g., 21 inches of tool length as compared to 39 inches of tool length), in relation to the triple piston design or the pressure intensifier design wherein it is always activated.

Given the foregoing, the present disclosure has further recognized that if one can selectively activate the pressure intensifier at a predetermined point (e.g., toward the end of the total setting stroke), the system may receive the benefits of the pressure intensifier (e.g., amplified force) without all of the drawbacks (e.g., increased tool length) of the triple piston design.

A number of different coupling mechanism may exist between the first piston and the second piston that would allow them to be physically coupled to one another at one point in time, and physically decoupled from one another at another point in time. In at least one embodiment, a shear pin (e.g., having a set shear value) may physically couple the first piston and the second piston together. In this embodiment, if the force applied to the second piston is below the shear value of the shear feature the first and second pistons will remain physically coupled, but once the force applied to the second piston is above the shear value of the shear feature the second piston will physically decouple from the first piston. At this state, the first and second pistons would be fluidly coupled to one another using the incompressible fluid, which would in turn activate the pressure intensifier. In yet another embodiment, a collet may be used to selectively couple or decouple the first and second pistons from one another. In yet another embodiment, a burst disc or fluid nozzle may be used to selectively couple or decouple the first and second pistons from one another.

The present disclosure has further recognized that the pressure intensifier design, and the selectively engageable pressure intensifier, may be used with other downhole devices, including valves (e.g., ball valves, interval control valves, etc.), sliding sleeves, etc. and remain within the scope of the present disclosure.

Figure 1:
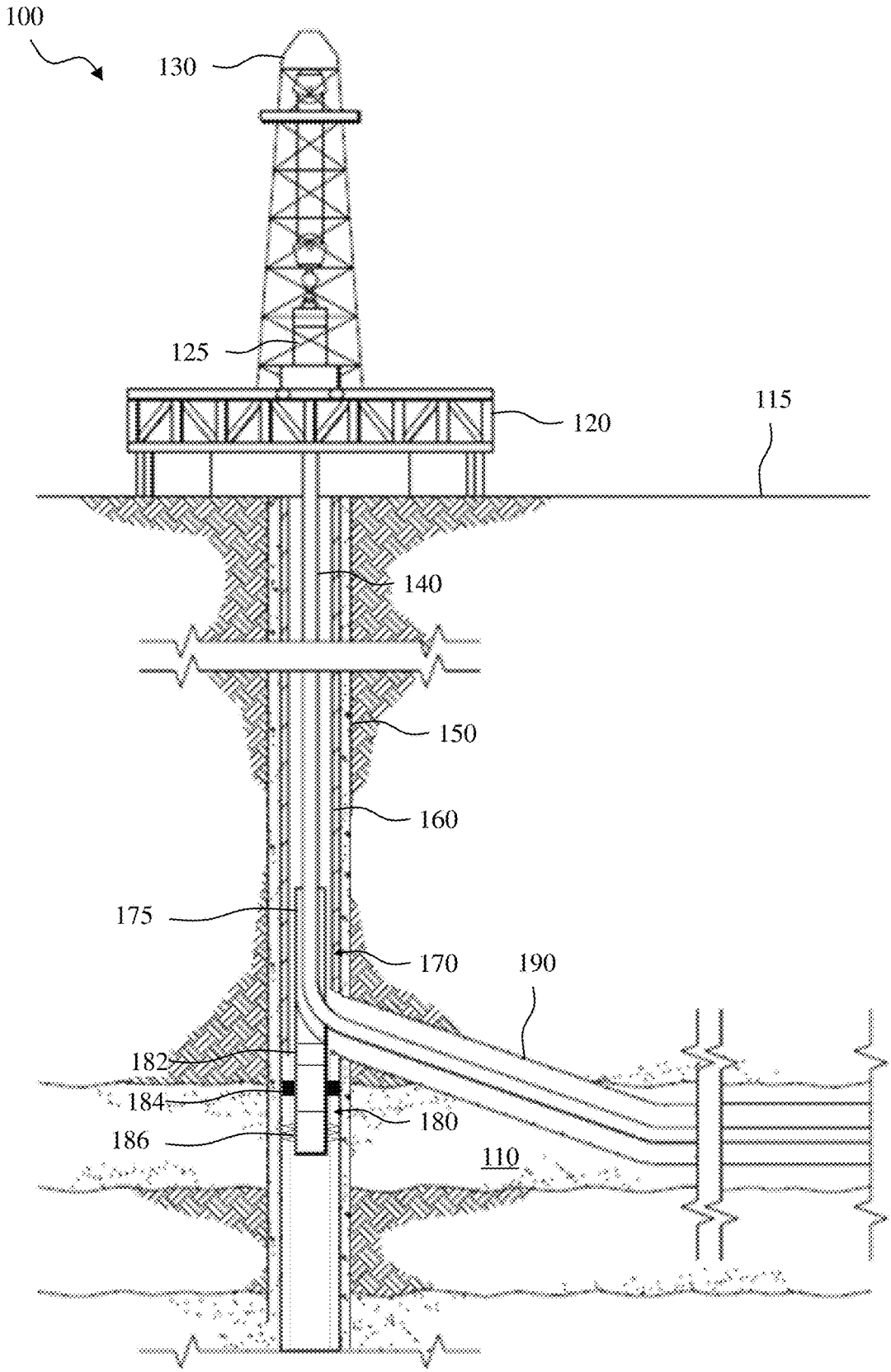
FIG. 1 illustrates a schematic view of a well system designed, manufactured and operated according to one or more embodiments disclosed herein.

FIG. 1 is a schematic view of a well system 100 designed, manufactured and operated according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering one or more downhole tools including pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based well systems different from that illustrated.

As shown, a main wellbore 150 has been drilled through the various earth strata, including the subterranean formation 110. The term "main" wellbore is used herein to designate a wellbore from which another wellbore is drilled. It is to be noted, however, that a main wellbore 150 does not necessarily extend directly to the earth's surface, but could instead be a branch of yet another wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

In the embodiment of FIG. 1, a whipstock assembly 170 according to one or more embodiments of the present disclosure is positioned at a location in the main wellbore 150. Specifically, the whipstock assembly 170 could be placed at a location in the main wellbore 150 where it is desirable for a lateral wellbore 190 to exit. Accordingly, the whipstock assembly 170 may be used to support a milling tool used to penetrate a window in the main wellbore 150, and once the window has been milled and a lateral wellbore 190 formed, in some embodiments, the whipstock assembly 170 may be retrieved and returned uphole by a retrieval tool.

The whipstock assembly 170, in at least one embodiment, includes a whipstock element section 175, as well as a sealing/anchoring assembly 180 coupled to a downhole end thereof. The sealing/anchoring assembly 180, in one or more embodiments, includes an orienting receptacle tool assembly 182, a sealing assembly 184, and an anchoring assembly 186. The orienting receptacle tool assembly 182, in one or more embodiments, along with a collet and one or more orienting keys, may be used to land and positioned a guided milling assembly and/or the whipstock element section 175 within the casing string 160. The sealing assembly 184, in at least one embodiment, seals (e.g., provides a pressure tight seal) an annulus between the whipstock assembly 170 and the casing string 160. In at least one embodiment, the anchoring assembly 186 axially, and optionally rotationally, fixes the whipstock assembly 170 within the casing string 160.

The elements of the whipstock assembly 170 may be positioned within the main wellbore 150 in one or more separate steps. For example, in at least one embodiment, the sealing/anchoring assembly 180, including the orienting receptacle tool assembly 182, sealing assembly 184 and the anchoring assembly 186 are run in hole first, and then set within the casing string 160. In the illustrated embodiment, the sealing assembly 184 is located within an open-hole section of the wellbore 150. In other embodiments, however, the sealing assembly 184 could be located within the casing 160. Thereafter, the sealing assembly 184 may be pressure tested. Thereafter, the whipstock element section 175 may be run in hole and coupled to the sealing assembly 180, for example using the orienting receptacle tool assembly 182. What may result is the whipstock assembly 170 illustrated in FIG. 1.

In one or more embodiments, the sealing/anchoring assembly 180 includes a pressure intensifier designed, manufactured and/or operated according to one or more embodiments of the disclosure. In one or more other embodiments, the well system 100 further includes a valve assembly, and the valve assembly includes a pressure intensifier designed, manufactured and/or operated according to one or more embodiments of the disclosure.

Turning now to FIGS. 2A through 2I, illustrated are different cross-sectional views of various deployment states of a downhole tool 200 designed, manufactured and/or operated according to one or more embodiments of the disclosure. The downhole tool 200, in the illustrated embodiment of FIGS. 2A through 2I, includes a mandrel 210. The mandrel 210, in the illustrated embodiment, may be centered about a centerline (CL). The mandrel 210, in one or more embodiments, is a tubular mandrel such as an inner tubular. The downhole tool 200, in at least the embodiment of FIGS. 2A through 2I, additionally includes a bore 295 positioned around the mandrel 210. The bore 295, in at least one embodiment, is a wellbore, such as an open-hole wellbore. The bore 295, in at least one other embodiment, is an outer tubular positioned within a wellbore, such as casing, production tubing, etc. In accordance with one aspect of the disclosure, the mandrel 210 and the bore 295 form an annulus 290.

In accordance with one embodiment of the disclosure, the downhole tool 200 includes a sealing element 220 (e.g., an elastomeric sealing element). The sealing element 220, in one or more embodiments, is operable to move between a radially retracted state, such as that shown in FIGS. 2A and 2B, a first radially expanded state, such as that shown in FIGS. 2D and 2E (e.g., partially radially expanded state), and a second radially expanded state, such as that shown in FIGS. 2G and 2H (e.g., fully radially expanded state). While a single sealing element 220 is illustrated in FIGS. 2A through 2I, other embodiments exist wherein multiple sealing elements 220 are employed, whether together or spaced apart in series along the mandrel 210. In the embodiment of FIGS. 2A through 2I, the sealing element 220 comprises a non-swellable elastomer, among other types and materials. In yet another embodiment, the sealing element 220 is an anchor element, and thus may have one or more anchoring features thereon.

In the illustrated embodiment of FIGS. 2A through 2I, first and second collar sleeves 240*a*, 240*b*, straddle ends of the sealing element 220.

In the embodiment of FIGS. 2A through 2I, a sliding element 250 (e.g., an axial sliding element) is positioned radially about the mandrel 210 and coupled with the first end of the sealing element 220. In one or more other embodiments, the first collar sleeve 240*a* and the sliding element 250 are a single combined feature, as opposed to the multiple separate features shown in FIGS. 2A through 2I.

Those skilled in the art appreciate that one or more anti-extrusion devices such as shoes (not shown) may be used on the downhole tool 200. Similarly, those skilled in the art appreciate the desire and/or need for the first and second collar sleeves 240*a*, 240*b*. For example, in the illustrated embodiment of FIGS. 2A through 2I, the first and second collar sleeves 240*a*, 240*b* are configured to axially slide relative to one another to move the sealing element 220 between the radially retracted state, such as that shown in FIGS. 2A and 2B, the first radially expanded state, such as that shown in FIGS. 2D and 2E (e.g., partially radially expanded state), and the second radially expanded state, such as that shown in FIGS. 2G and 2H (e.g., fully radially expanded state).

In the embodiment of FIGS. 2A through 2I, the downhole tool 200 additionally includes a pressure intensifier 260 positioned radially about the mandrel 210 and coupled to the sliding element 250. The pressure intensifier 260, in one or more embodiments, includes a first piston 262 (e.g., primary piston) having a first pressure receiving end 264 with a larger piston surface area ($A_{L1}$) and a first pressure output end 266 with a smaller piston surface area ($A_S$). The pressure intensifier 260, in one or more embodiments, may further include a second piston 268 coupled to the first piston 262, the second piston 268 having a second pressure receiving end 270 with a larger piston surface area ($A_{L2}$). In the illustrated embodiment, a second end 272 of the second piston 268 is coupled with the sliding element 250. For example, in at least one embodiment, the second piston 268 of the pressure intensifier 260 is in a same force path as the first piston 262 of the pressure intensifier 260, and for example in certain other embodiments the same force path as the sliding element 250.

Those skilled in the art will appreciate that in the images the first pressure receiving end 264 is shown to be in communication with the tubing via a port, but other embodiments may be designed without departing from the scope of the invention. Alternate embodiments include a control line operated tool, a tool operated using a downhole pump, actuator or other power source etc. Alternate embodiments also include a tool whereby the fluid receiving end 264 is initially isolated from any pressure or power source using devices such as a burst disc. When it is desired to actuate the tool, the burst disk may be ruptured by applied pressure or a shifting tool allowing the wellbore hydrostatic pressure to set the tool in line with this invention thereby alleviating the need for any applied pressure from surface or other power source.

Those skilled in the art, given this disclosure, understand how the larger piston surface area ($A_{L1}$) of the first pressure receiving end 264, the smaller piston surface area ($A_S$) of the first pressure output end 266, and the larger piston surface area ($A_{L2}$) of the second pressure receiving end 270, or at least the values thereof, may be tailored to provide different intensification amounts. For example, the less difference in area between the smaller piston surface area ($A_S$) of the first piston 262 and the larger piston surface area ($A_{L2}$) of the second piston 268, the less intensification. Nevertheless, the greater difference in area between the smaller piston surface area ($A_S$) of the first piston 262 and the larger piston surface area ($A_{L2}$) of the second piston 268, the greater intensification.

Further to the embodiment of FIGS. 2A through 2I, a fluid chamber 274 is defined between the first pressure output end 266 of the first piston 262 with the smaller piston surface area ($A_S$) and the second pressure receiving end 270 of the second piston 268 with the larger piston surface area ($A_{L2}$), for example using one or more sealing elements. In one or more embodiments, the fluid chamber 274 is filled with an incompressible fluid, such as for example a water-based liquid or oil-based liquid, among others. In one or more embodiments, fluid chamber 274 is filled with the wellbore fluid by having a one way valve to the tubing or annulus so as to allow surrounding fluid to enter chamber 274 and equalize pressure with the wellbore but prevent fluid from exiting chamber 274 when the pressure intensifier is activated.

In one or more embodiments, the pressure intensifier 260 is always activated. Accordingly, an application of an applied fluid pressure to the first pressure receiving end 264 of the first piston 262 will result in the application of an intensified fluid pressure at the second pressure receiving end 270 of the second piston 268. Accordingly, this intensified fluid pressure at the second pressure receiving end 270 of the second piston would translate into an intensified force applied to the second pressure receiving end 270 of the second piston 268, and thus to the sliding element 250 and ultimately the sealing element 220. The intensified fluid pressure and resulting intensified force would be achieved and discussed in detail above.

Figure 2A:
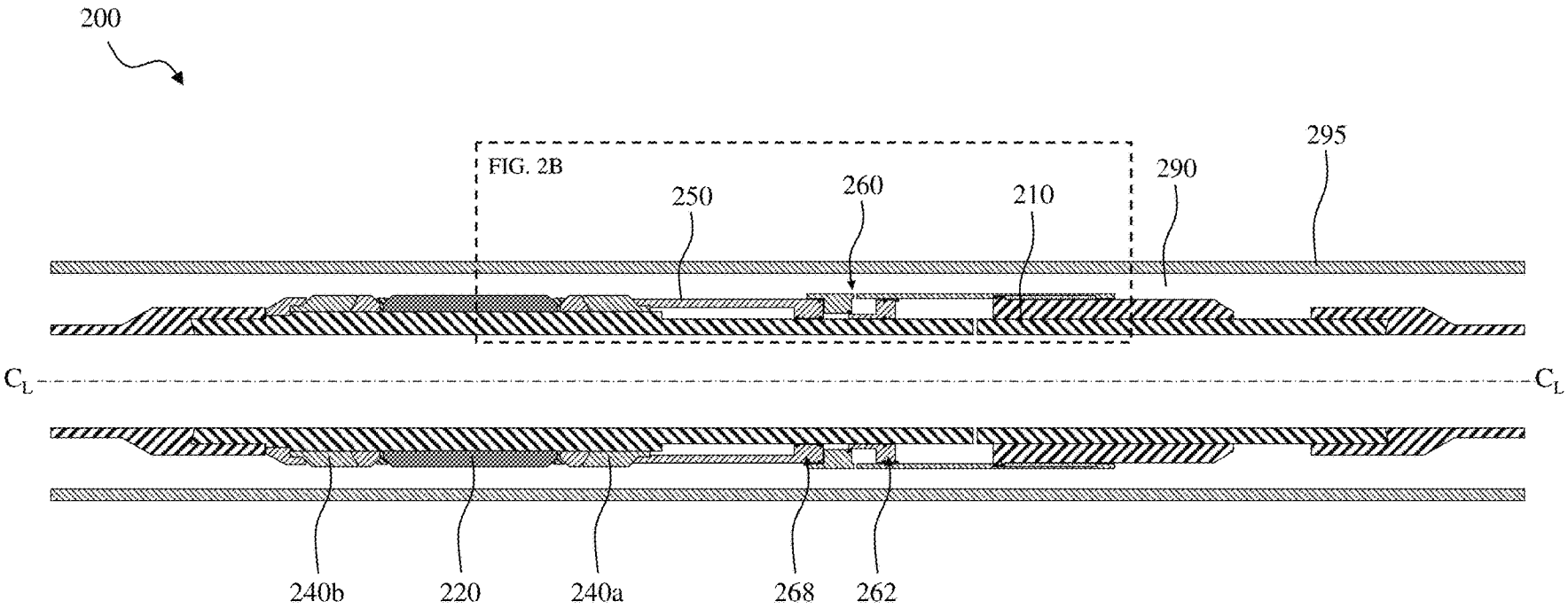
FIGS. 2A through 2I illustrate different cross-sectional views of various deployment states of a downhole tool designed, manufactured and/or operated according to one or more embodiments of the disclosure.
Figure 2B:
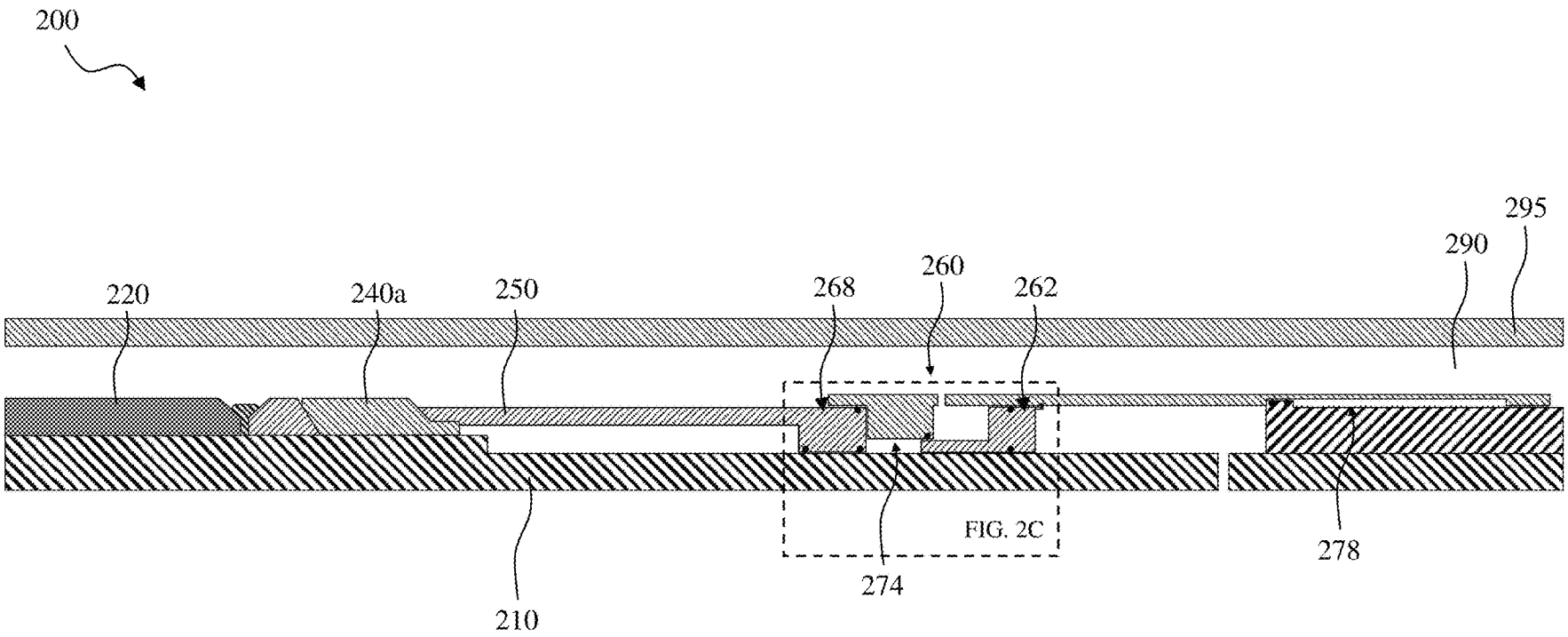
Figure 2C:
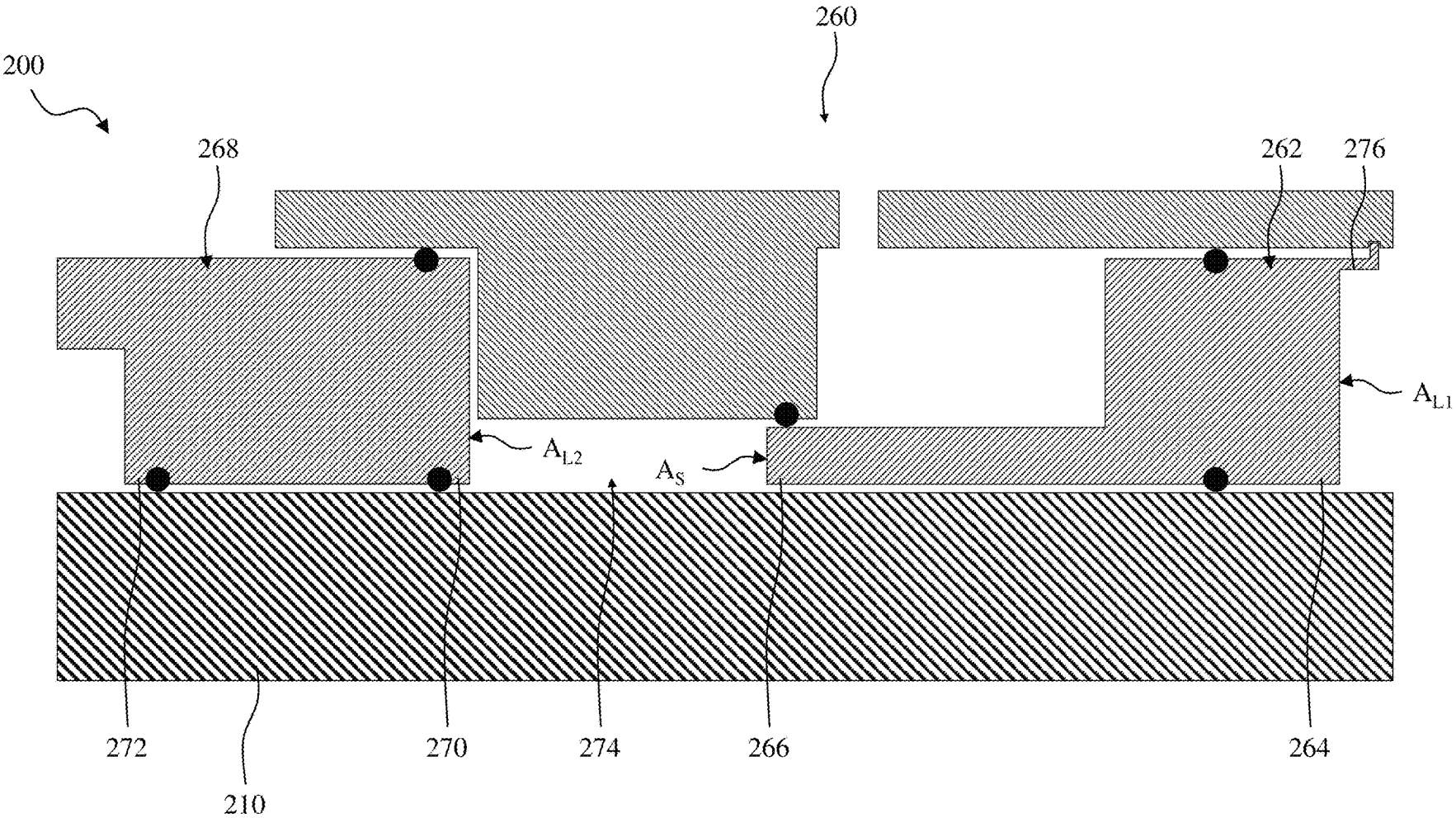
Figure 2D:
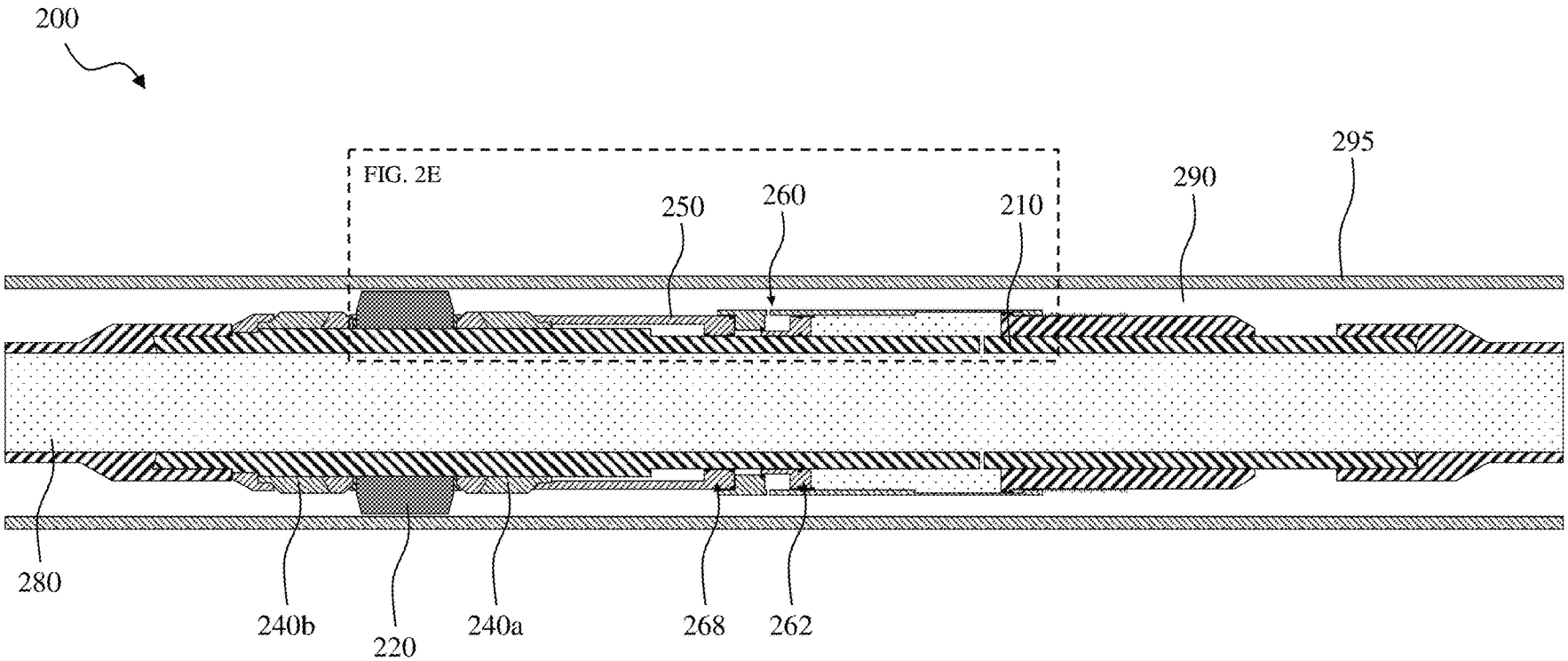
Figure 2E:
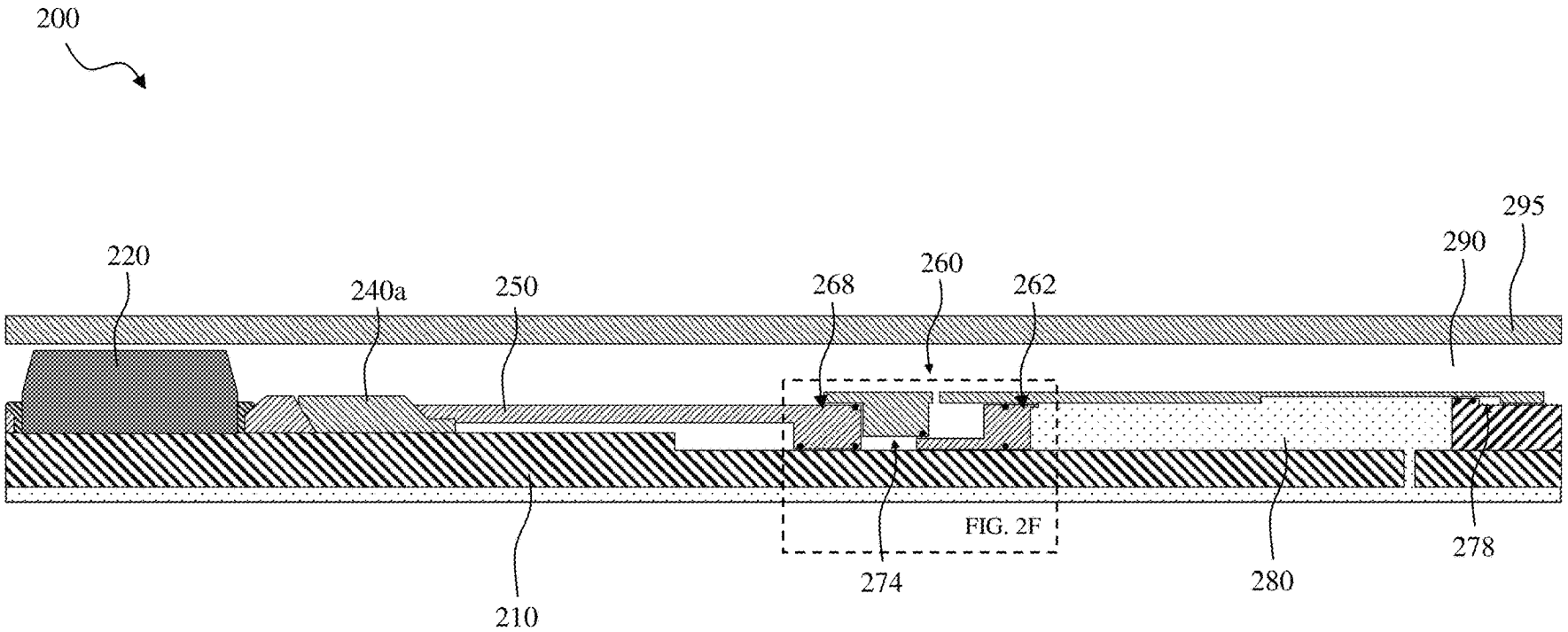
Figure 2F:
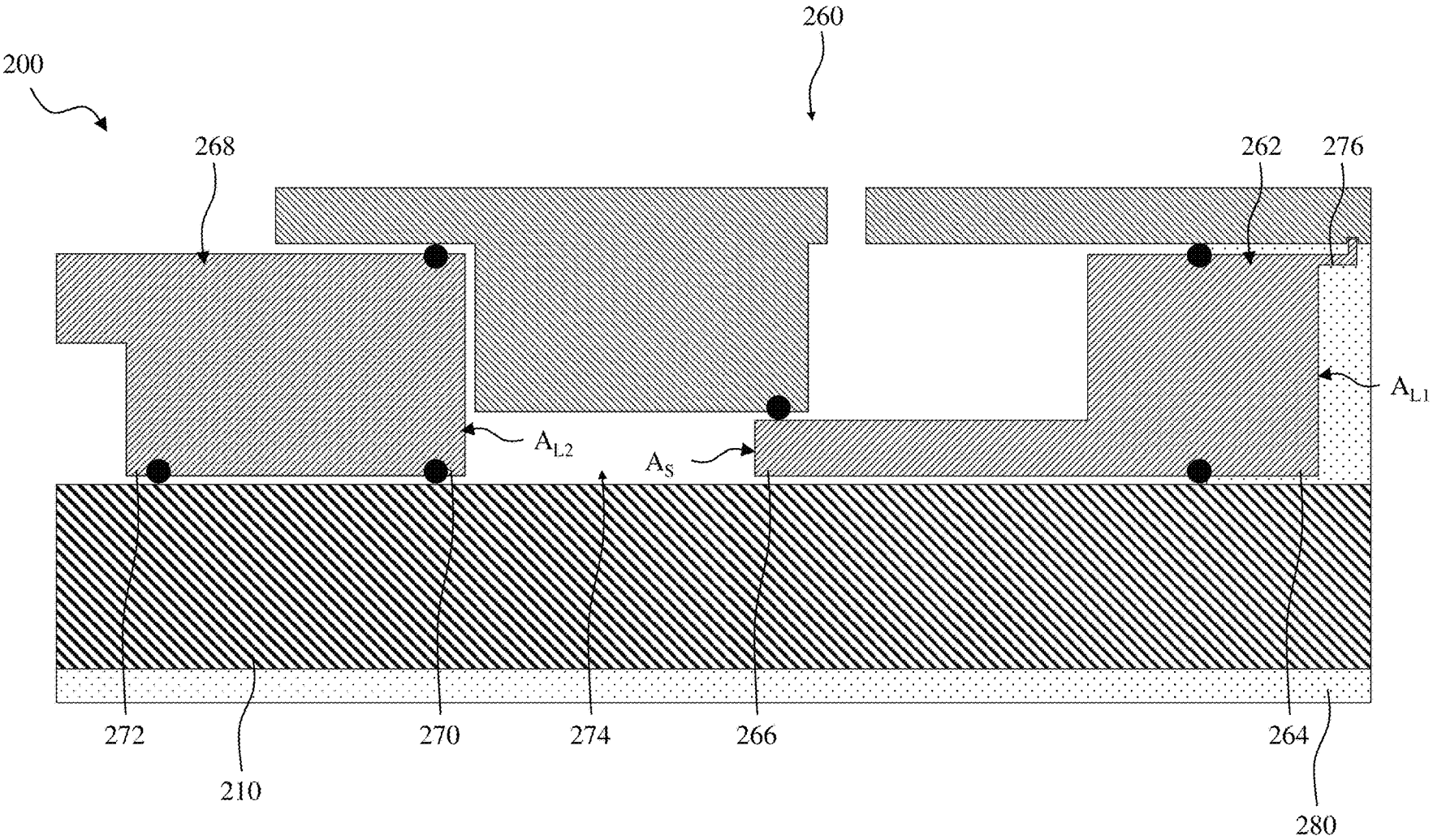
Figure 2G:
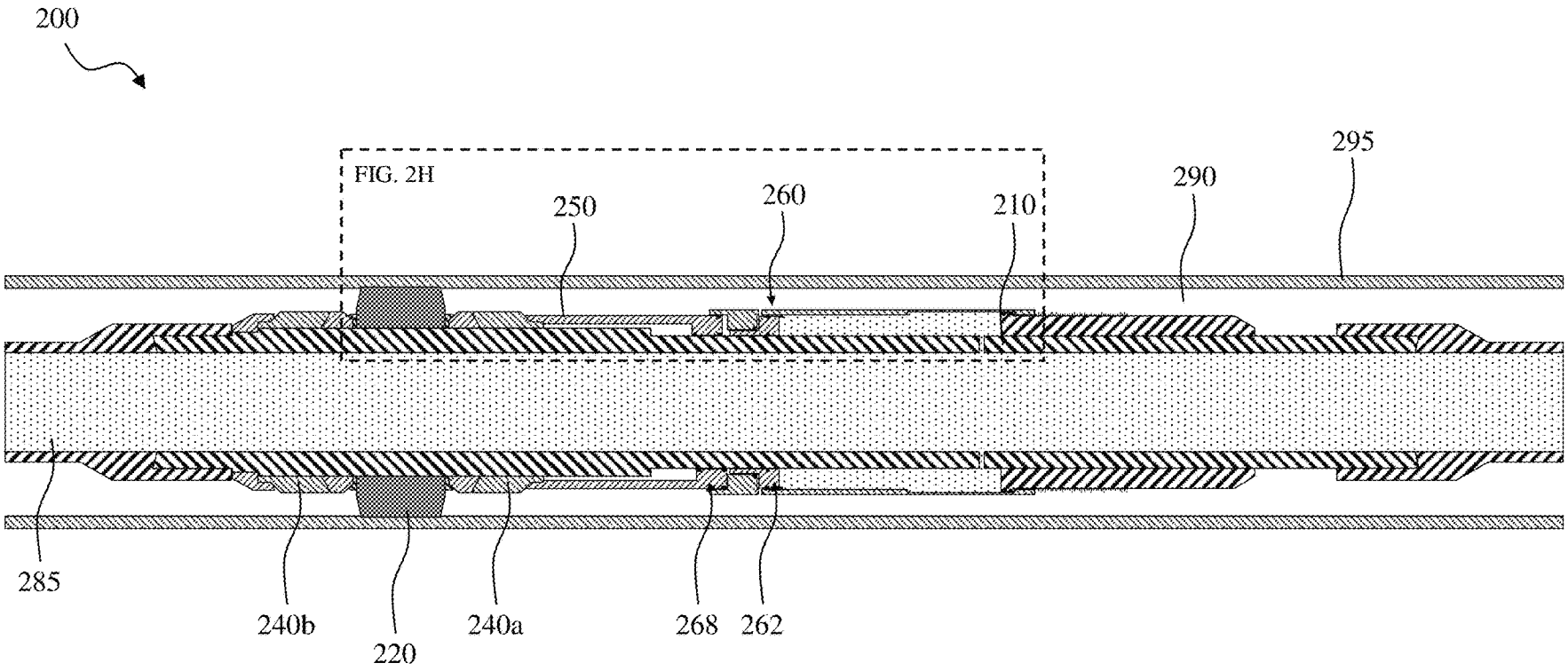
Figure 2H:
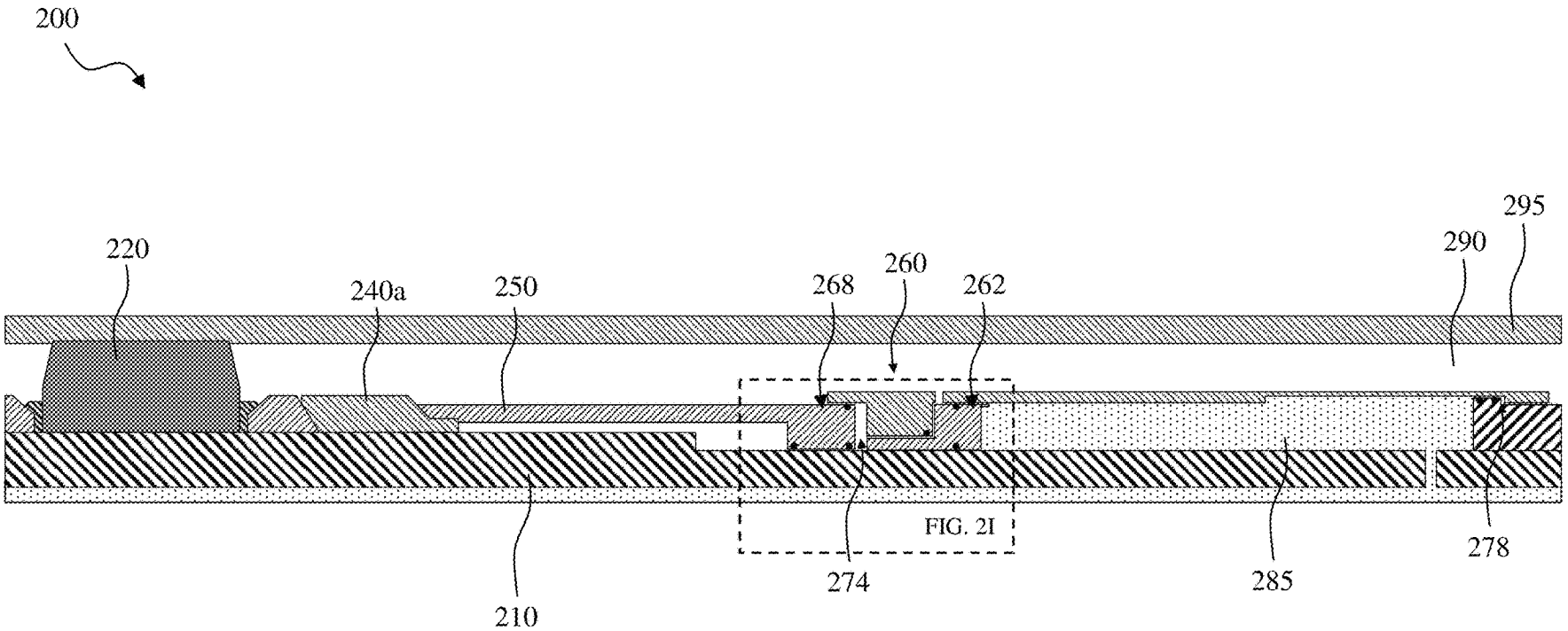
Figure 2I:
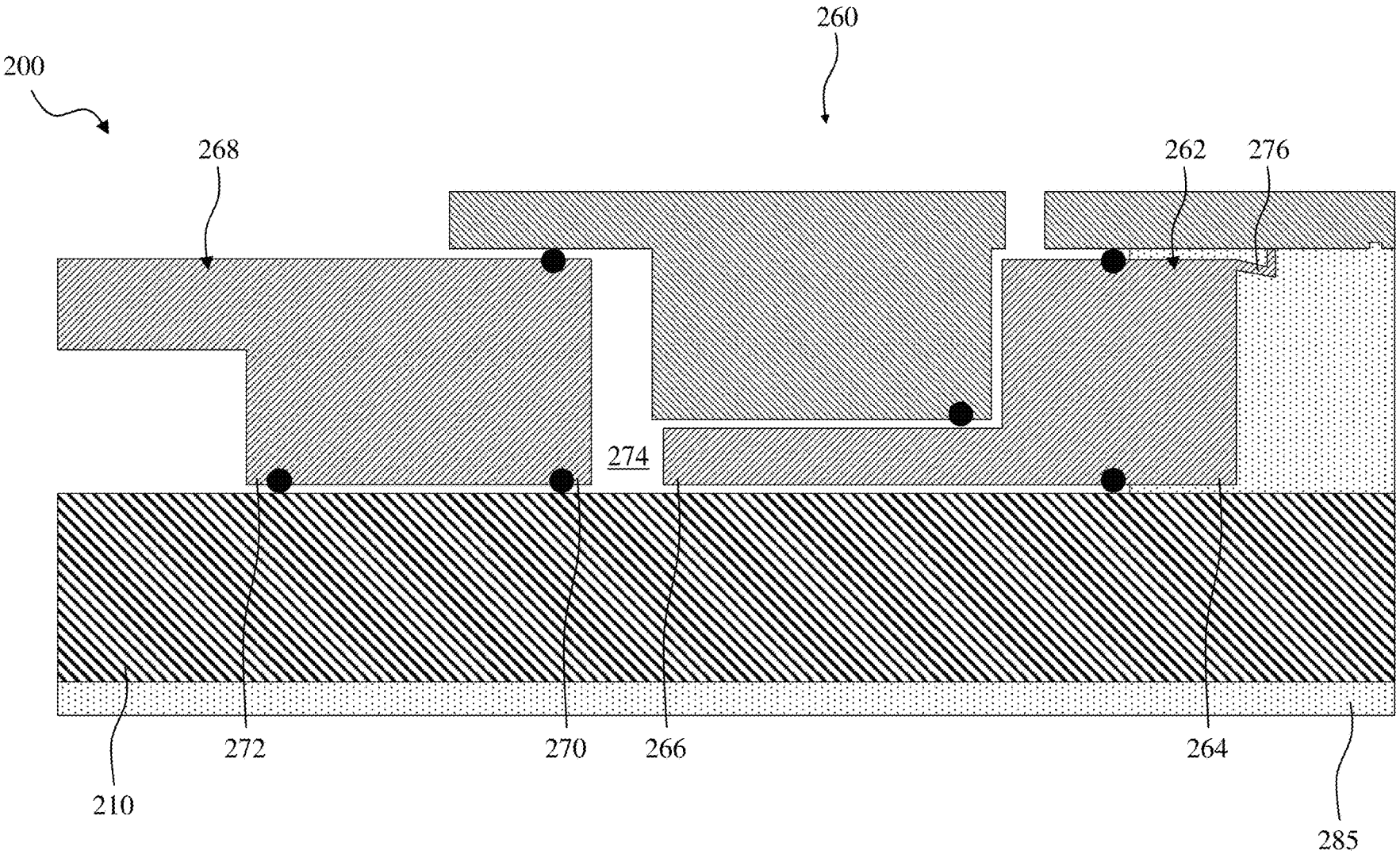
Figure 3A:
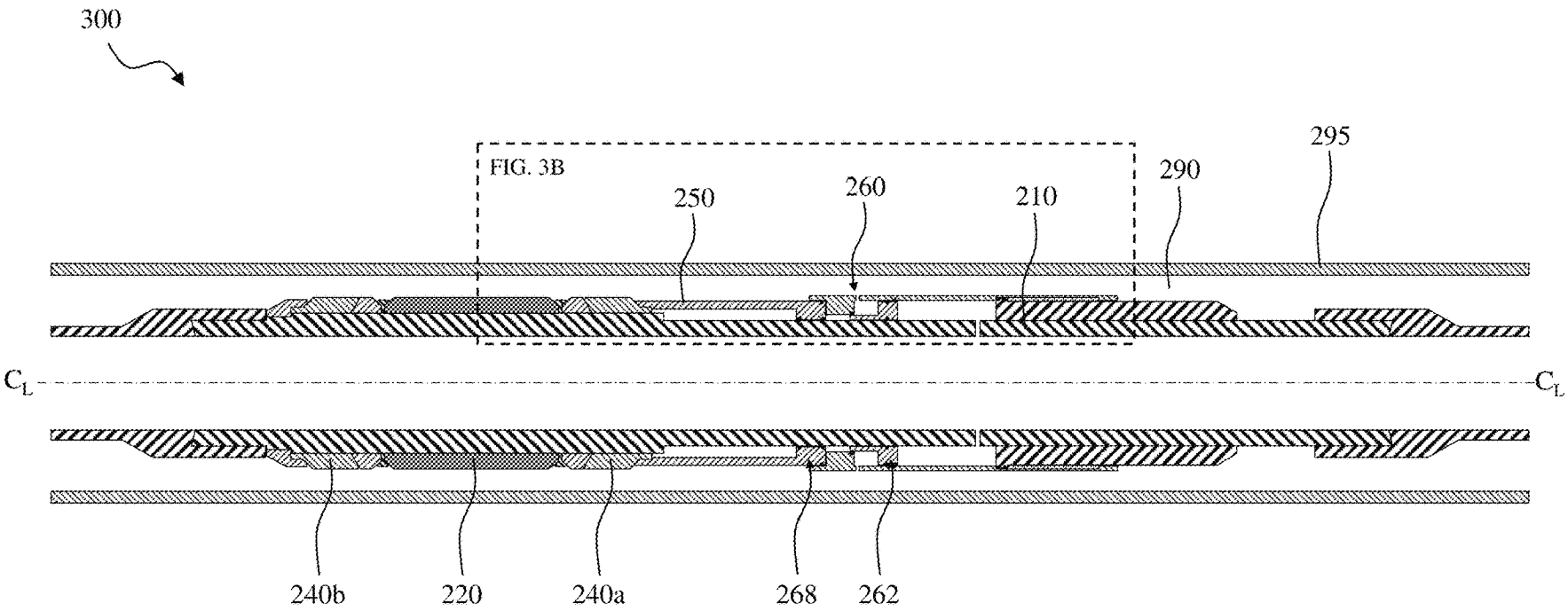
FIGS. 3A through 3I illustrate different cross-sectional views of various deployment states of a downhole tool designed, manufactured and/or operated according to one or more alternative embodiments of the disclosure.
Figure 3B:
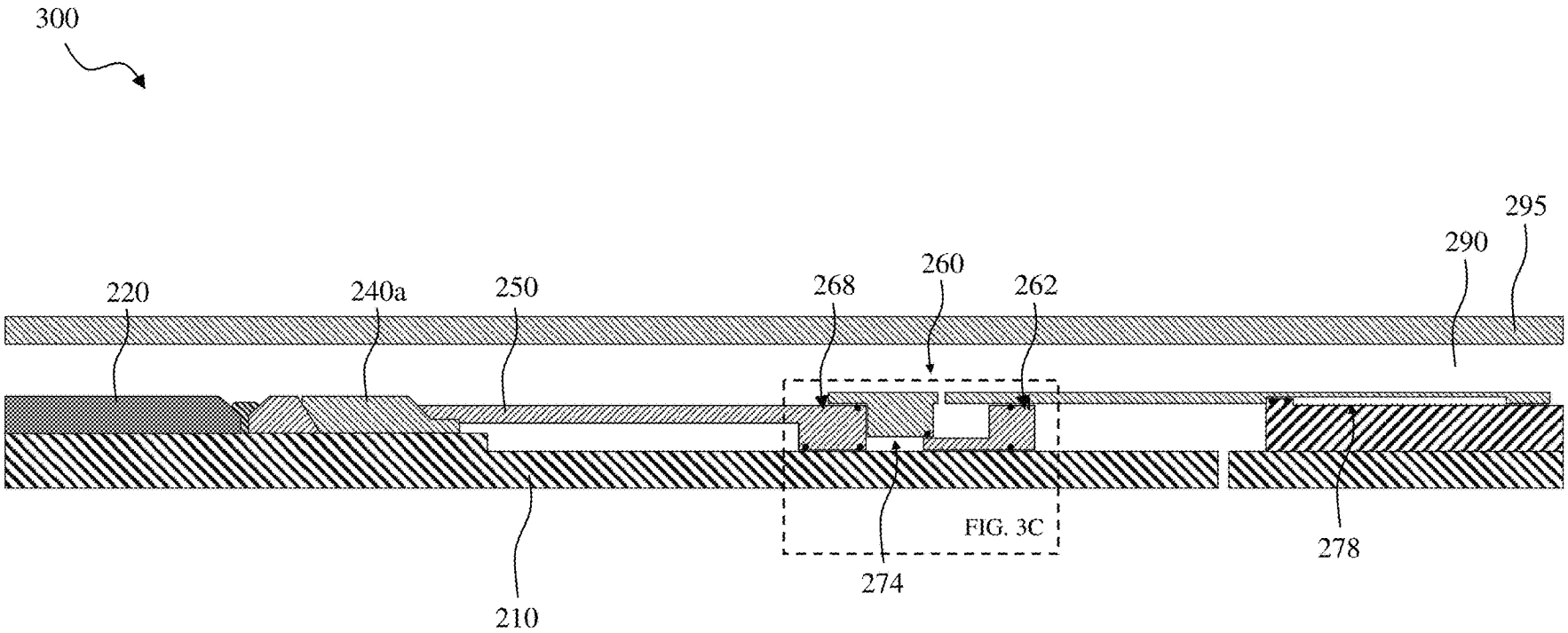
Figure 3C:
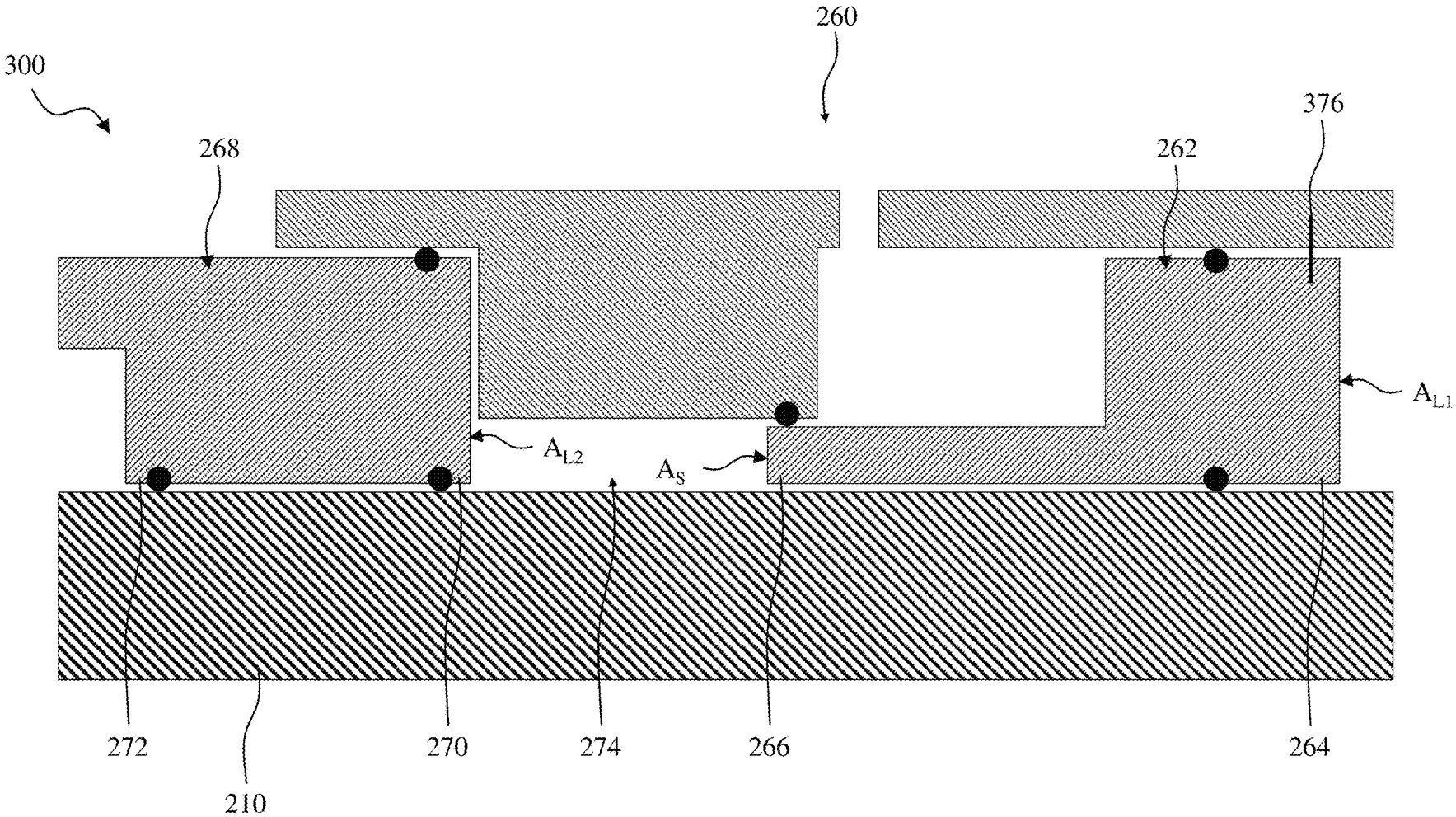
Figure 3D:
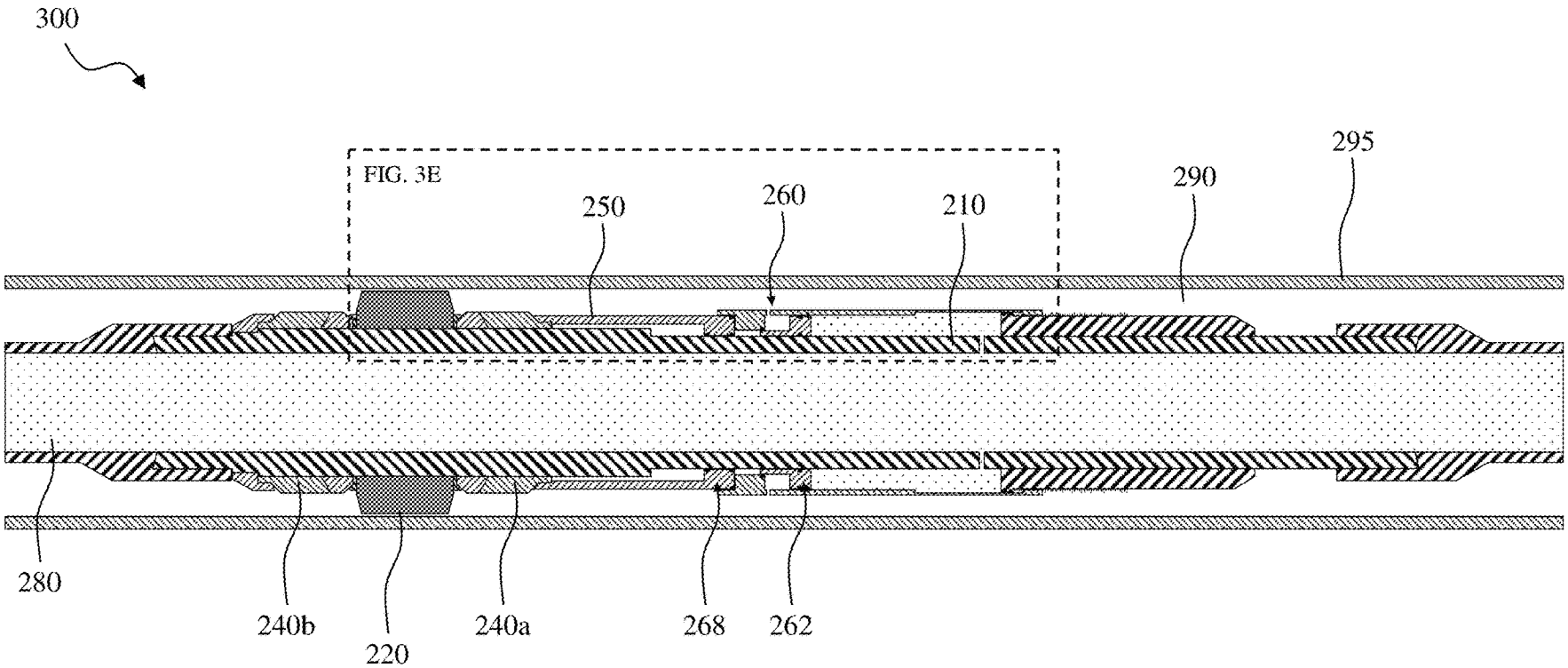
Figure 3E:
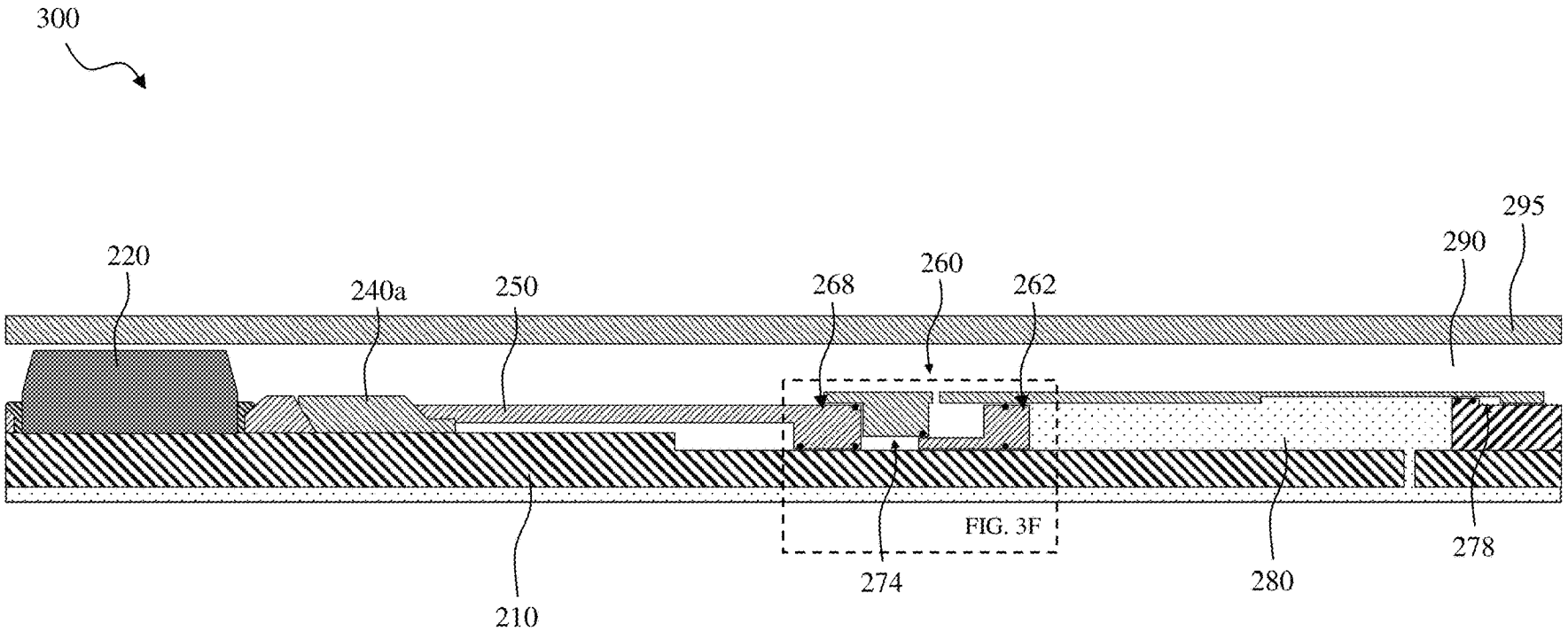
Figure 3F:
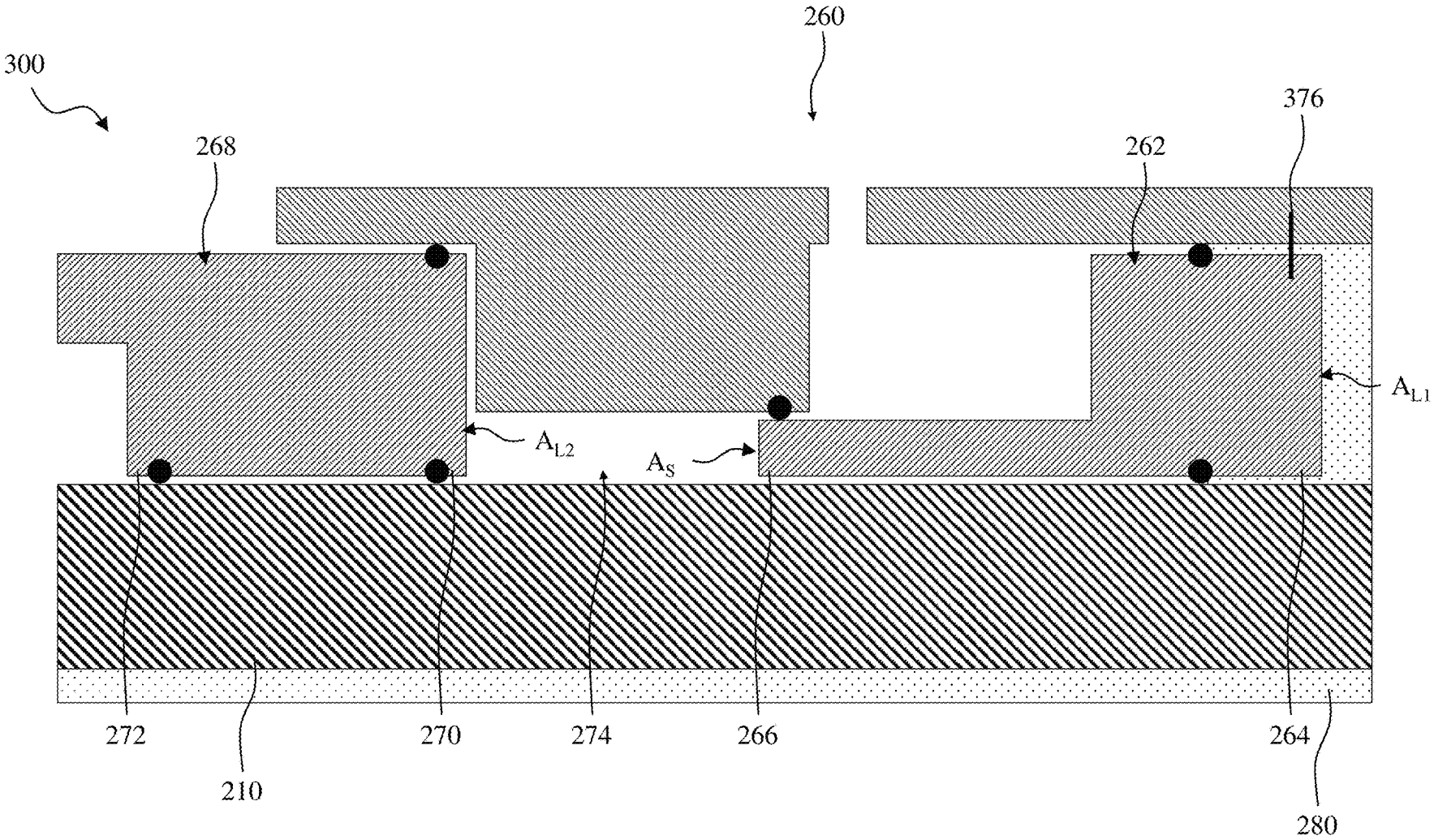
Figure 3G:
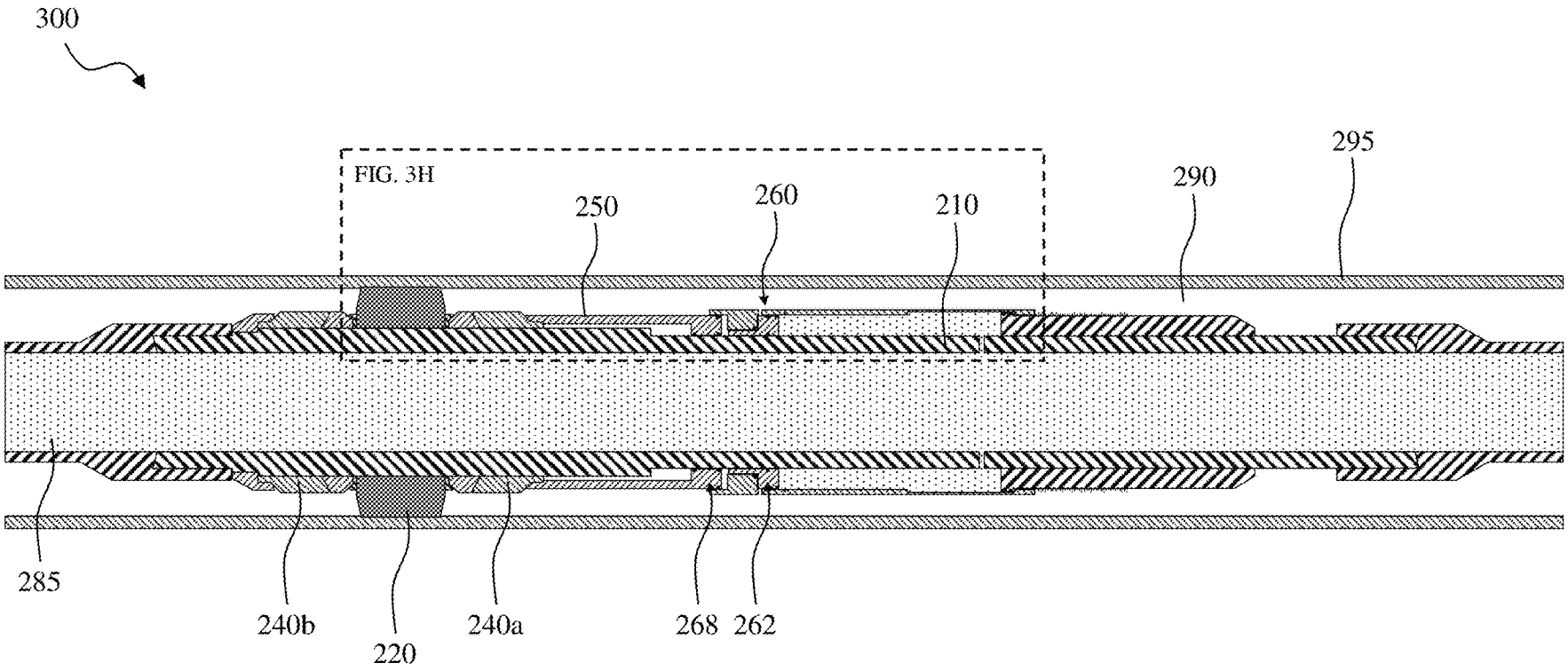
Figure 3H:
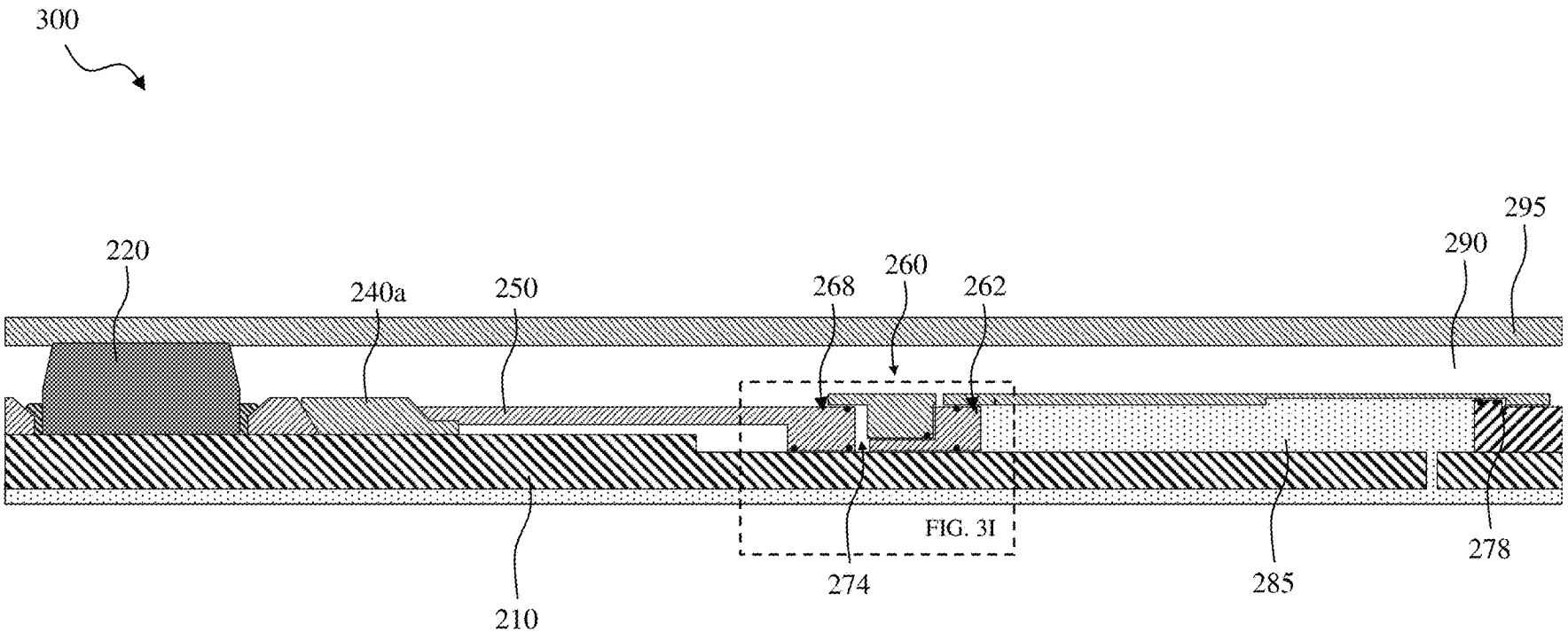
Figure 3I:
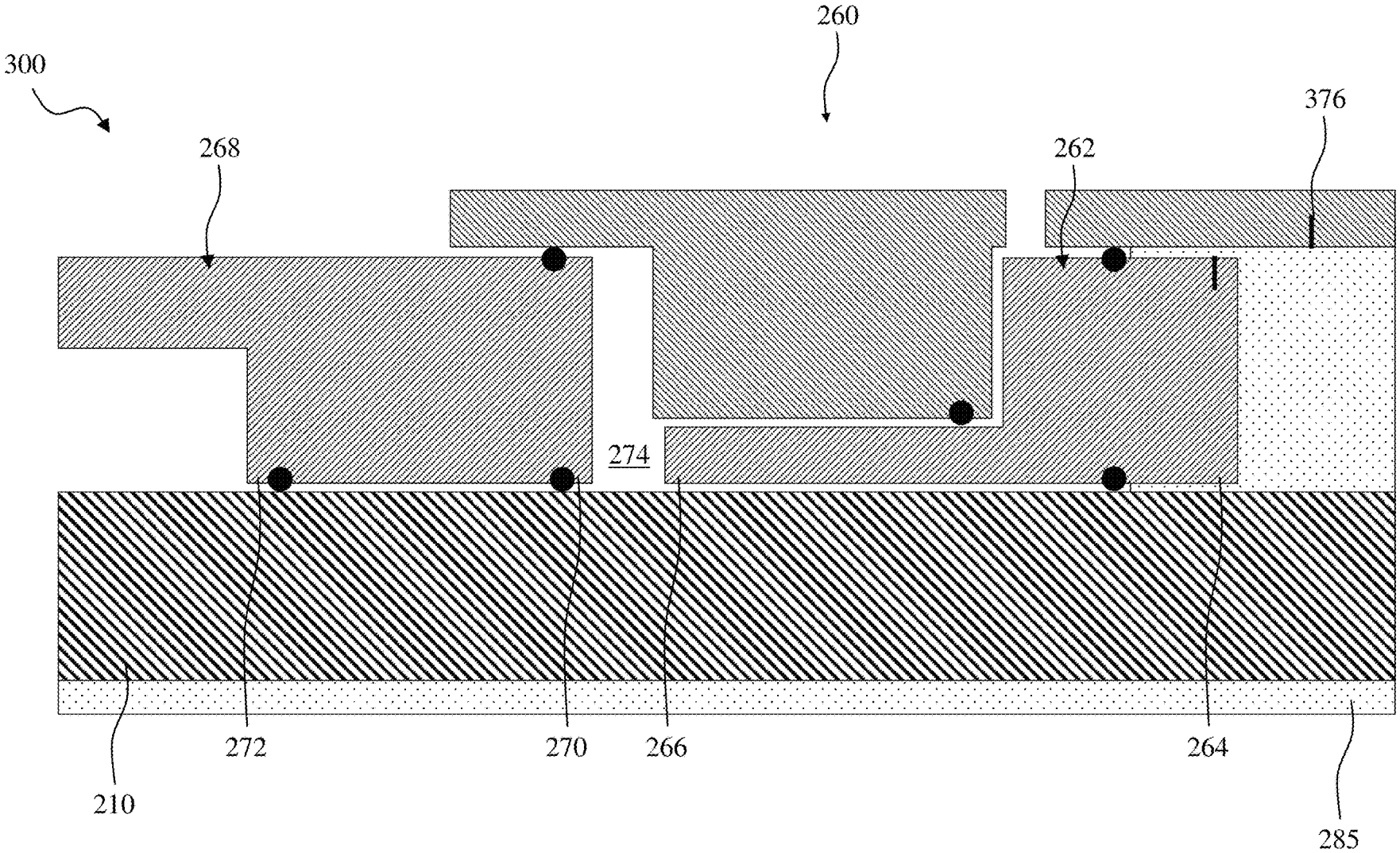
Figure 4A:
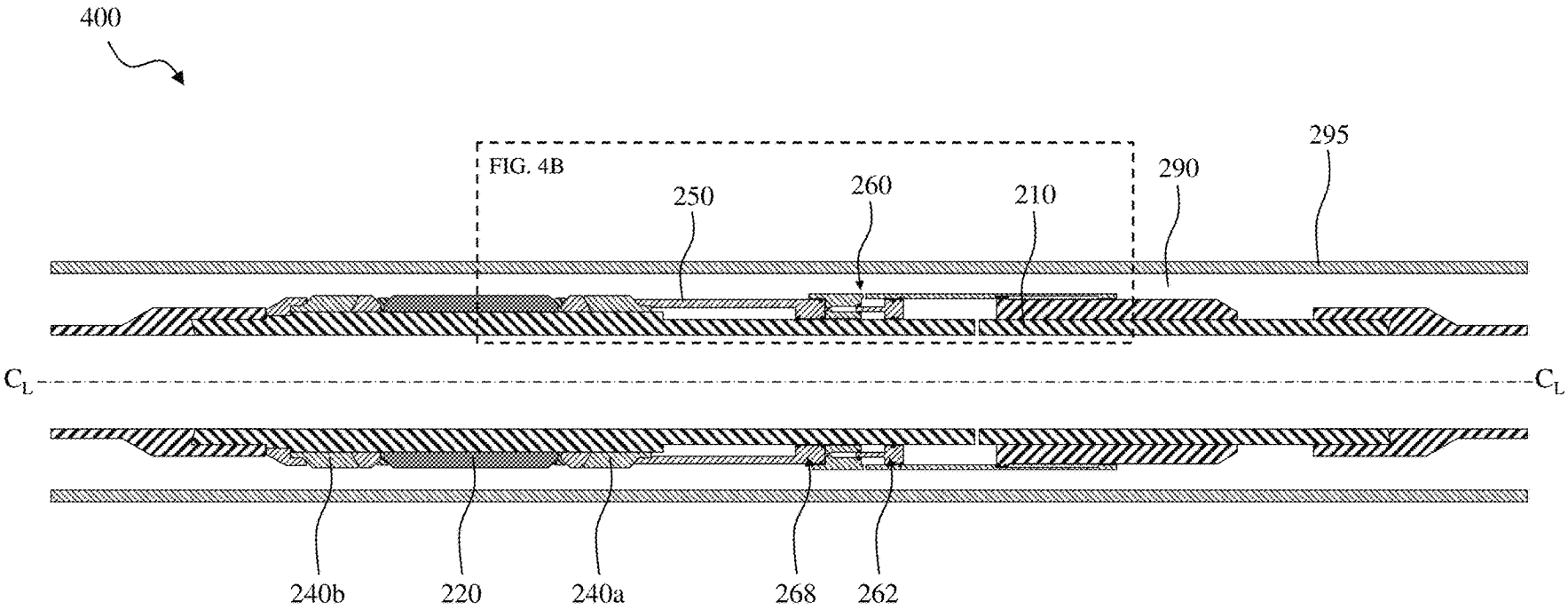
Figure 4B:
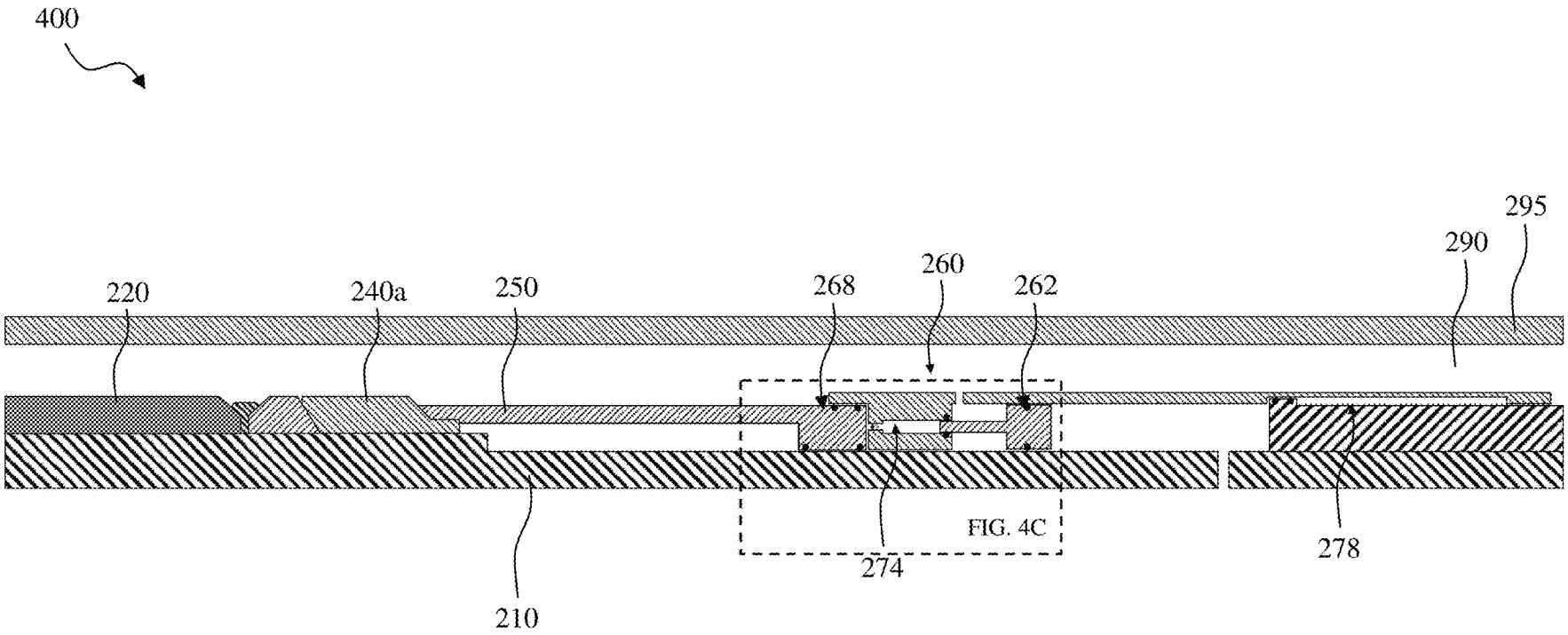
Figure 4C:
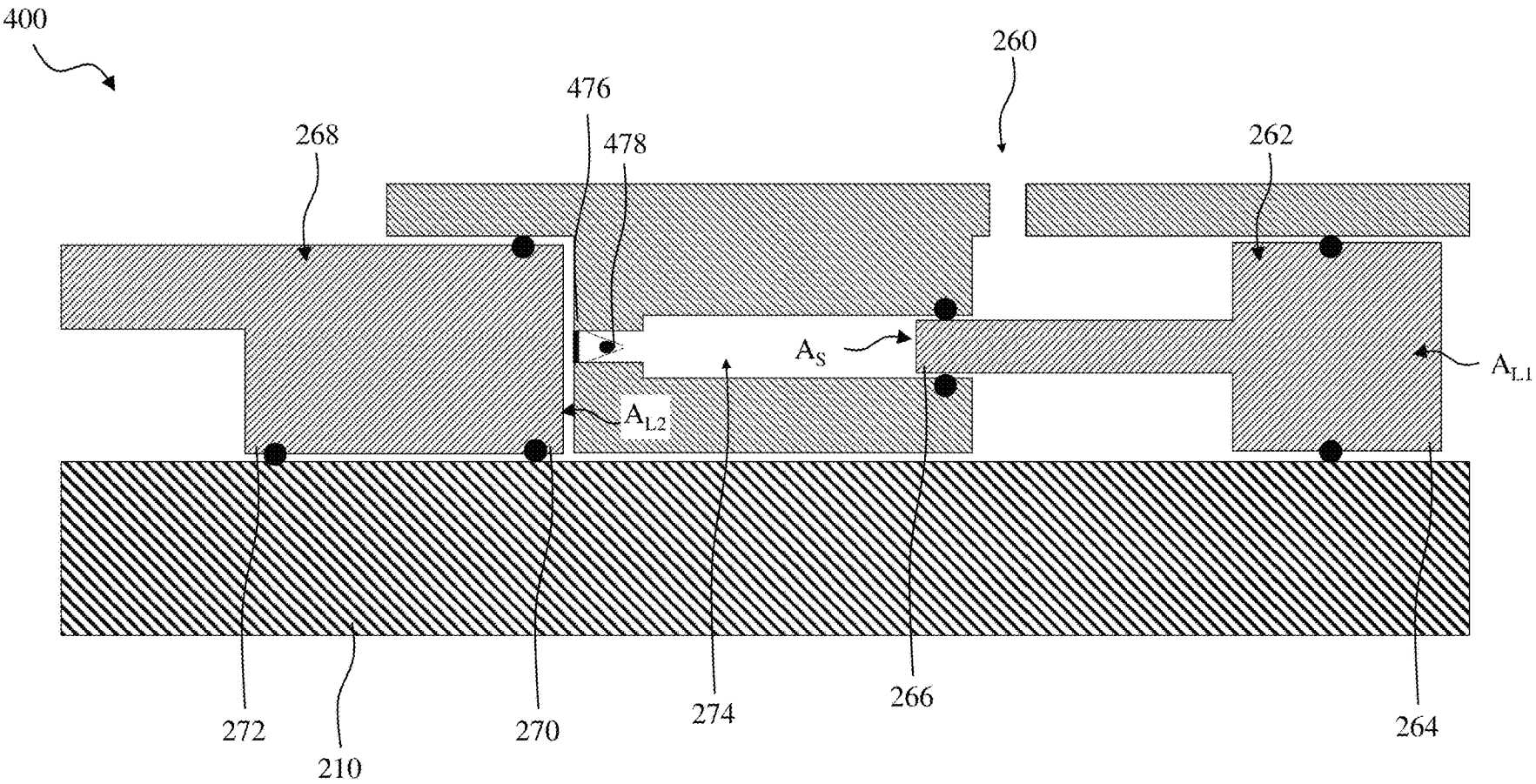
Figure 4D:
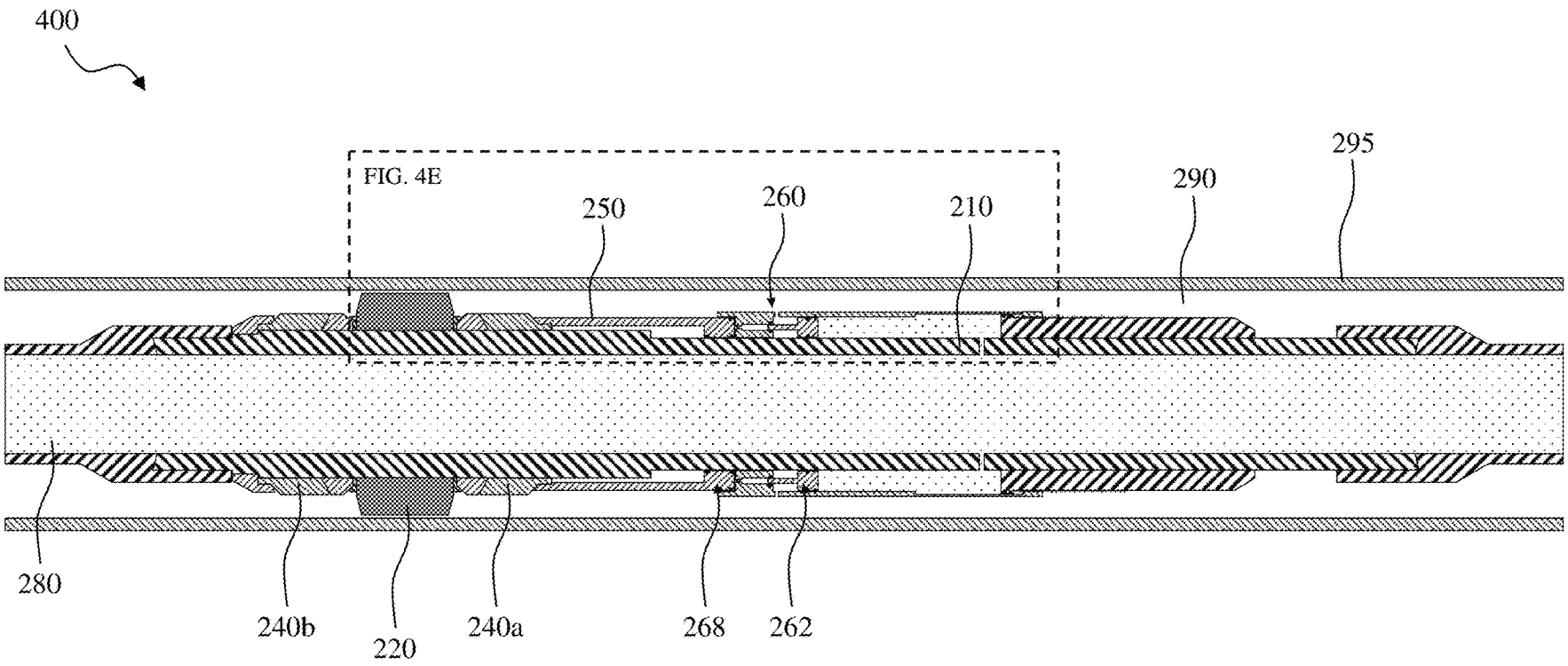
Figure 4E:
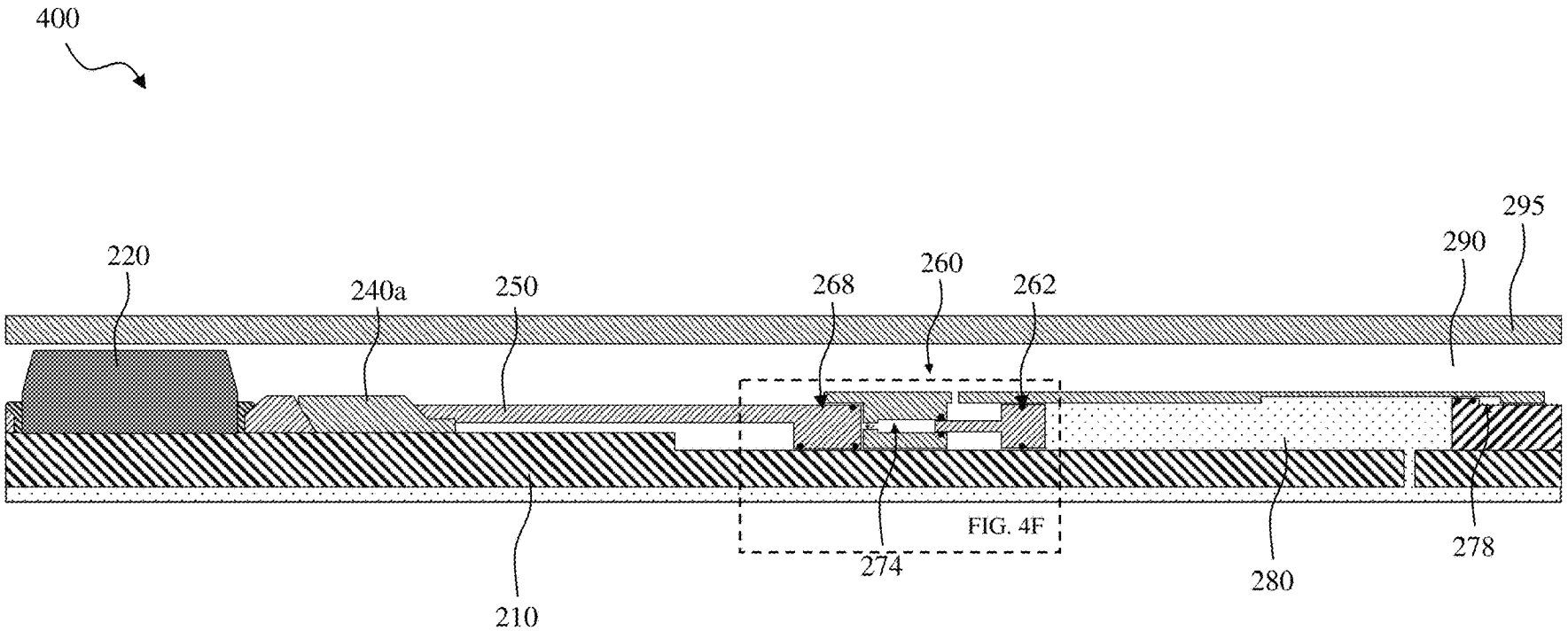
Figure 4F:
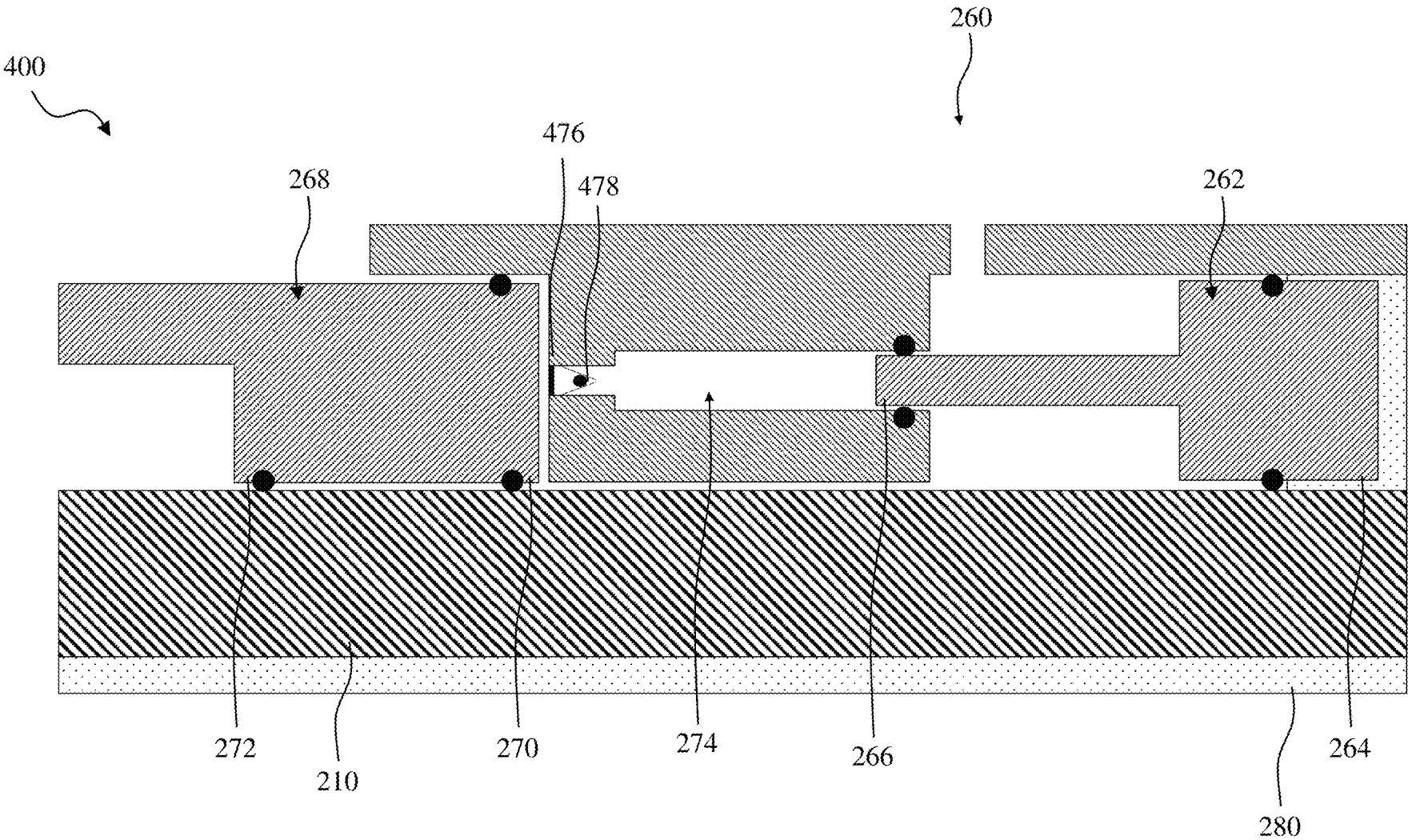
Figure 4G:
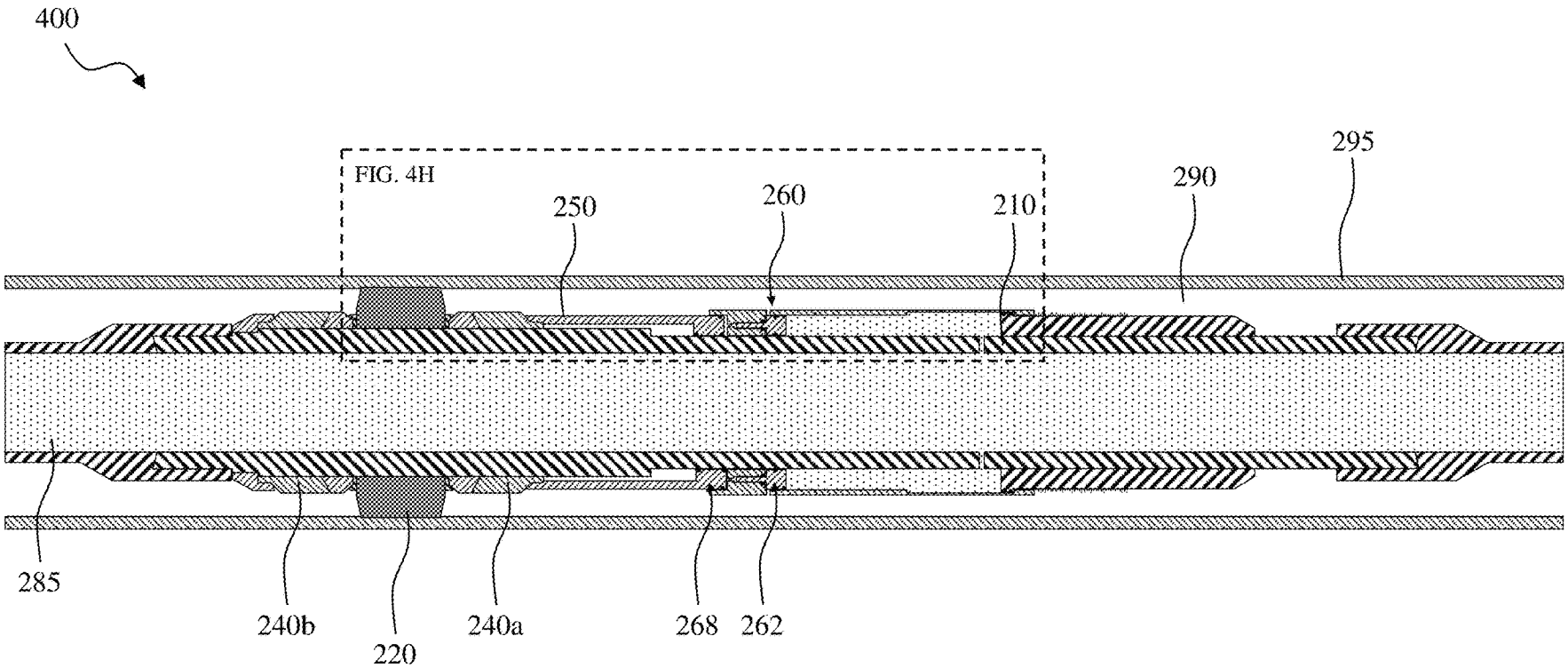
Figure 4H:
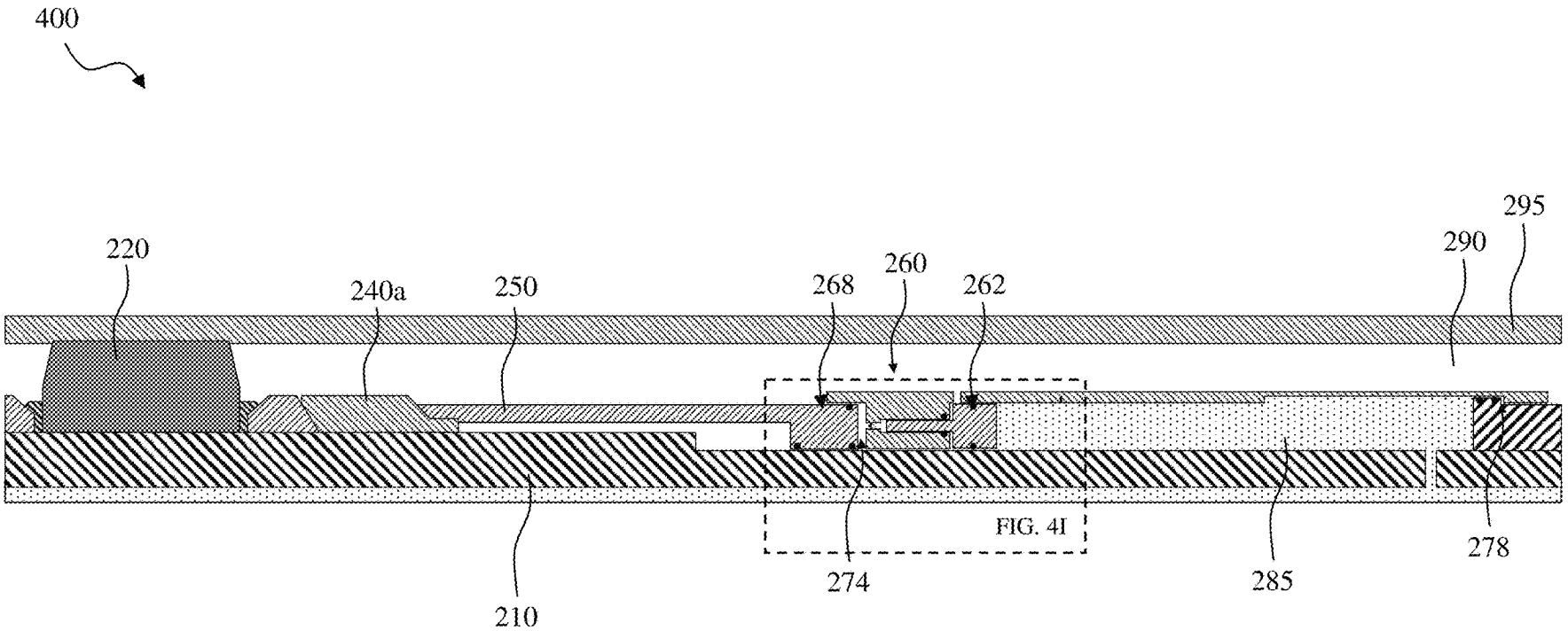
Figure 4I:
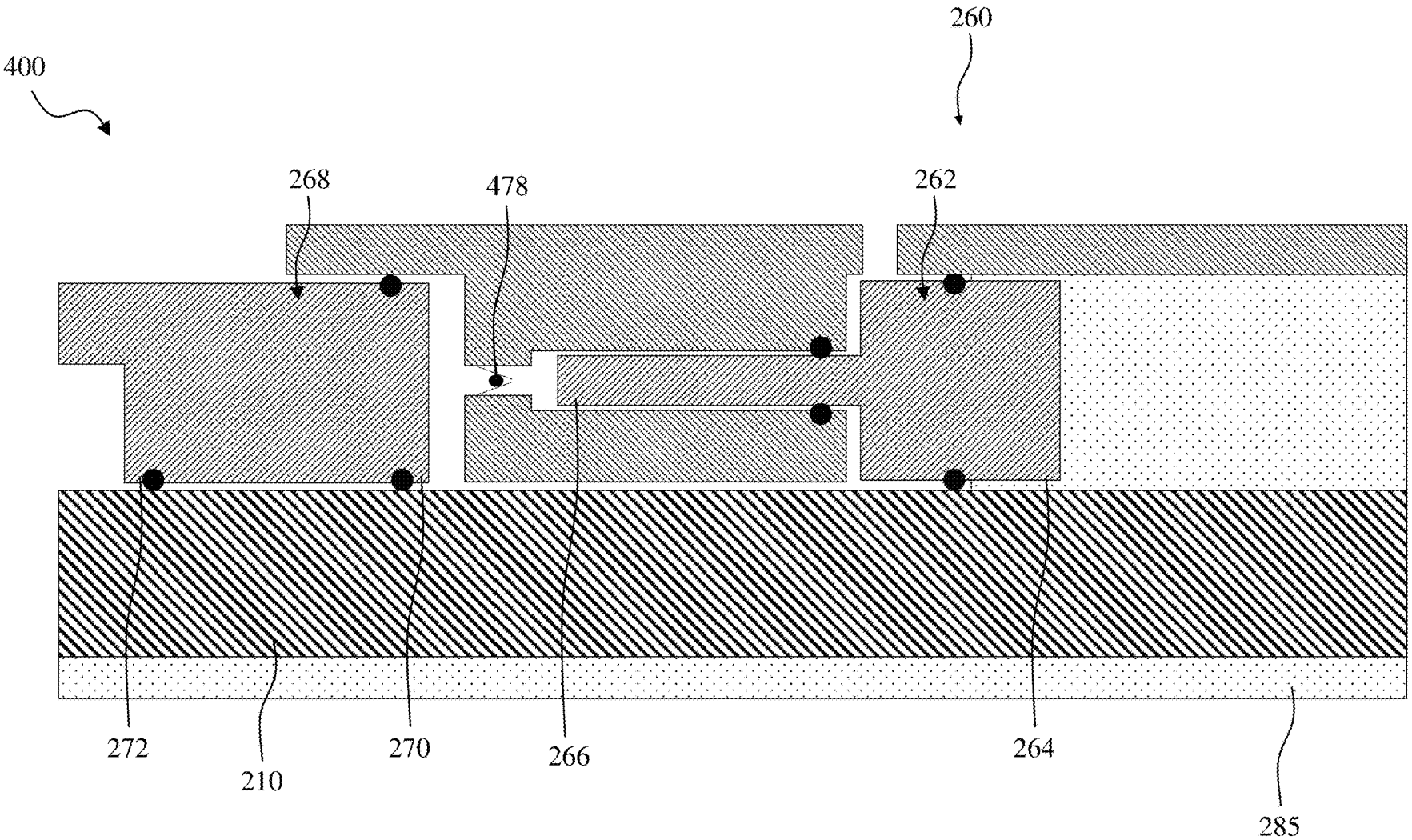

In one or more other embodiments, such as that shown in FIGS. 2A through 2I, the pressure intensifier 260 is a selectively engageable pressure intensifier. Accordingly, the selectively engageable pressure intensifier may be deactivated for a portion of the total stroke length of the sliding element 250, and then activated for a remaining portion of the total setting stroke of the sliding element 250, as discussed in detail above. For example, the selectively engageable pressure intensifier, in one or more embodiments, is configured to have an initial state (e.g., as shown in FIGS. 2A through 2F) physically coupling the first piston 262 and the second piston 268 with one another when subjected to an initial fluid pressure below a threshold fluid pressure, and is configured to have a subsequent state (e.g., as shown in FIGS. 2G through 2I) physically decoupling and fluidly coupling the first piston 262 and the second piston 268 with one another when subjected to a subsequent fluid pressure above the threshold fluid pressure.

In the illustrated embodiment of FIGS. 2A through 2I, the pressure intensifier 260 employs a collet feature 276 to make it selectively engageable. In this one embodiment, the collet feature 276 is configured to set the threshold fluid pressure, and thus remain engaged to physically couple the first piston 262 and the second piston 268 when the selectively engageable pressure intensifier 260 is subjected to an initial fluid pressure below the threshold fluid pressure, and disengage to physically decouple and fluidly couple the first piston 262 and the second piston 268 when the selectively engageable pressure intensifier 260 is subjected to a subsequent fluid pressure above the threshold fluid pressure. Those skilled in the art, given that disclosed herein, would understand how to design the collet feature 276 to stay engaged when subjected to the initial fluid pressure below the threshold fluid pressure and then disengage when subjected to the subsequent fluid pressure above the threshold fluid pressure.

In the illustrated embodiment of FIGS. 2A through 2I, the downhole tool 200 may additionally include one or more one way checks 278 to maintain engagement of the components and prevent the sealing element 220 from relaxing over time and/or if the fluid pressure drops. In at least one embodiment, the one or more one way checks 278 are a series of teeth that allow the sliding element 250 to slide one way (e.g., to the left in the disclosed embodiment), but not the other way (e.g., to the right in the disclosed embodiment). In yet another embodiment, the one or more one way checks 278 are one or more body lock rings, or one or more slips, etc. In yet another embodiment, the one or more one way checks are a fluid check valve that allows fluid to exit the intensifier 260 but not to re-enter the intensifier 260.

In the illustrated embodiments, FIGS. 2A through 2C illustrate the downhole tool 200 as it might exist in a run-in-hole state. FIGS. 2D through 2F, however, illustrate the downhole tool 200 as it might exist after applying an initial fluid 280 having an initial fluid pressure below the threshold fluid pressure thereto. The initial fluid 280, in one or more embodiments, moves the sliding element 250 a majority of its total setting stroke. Furthermore, as the initial fluid 280 having the initial fluid pressure is below the threshold fluid pressure, the first piston 262 and the second piston 268 remain physically coupled to one another (e.g., via the collet feature 276) while being subjected to this initial fluid pressure. Accordingly, the pressure intensifier feature is deactivated at this time.

FIGS. 2G through 2I illustrate the downhole tool 200 as it might exist after applying a subsequent fluid 285 having a subsequent fluid pressure above the threshold fluid pressure thereto. The subsequent fluid 285, in one or more embodiments, moves the sliding element 250 a remaining minority of its total setting stroke. Furthermore, as the subsequent fluid 285 having the subsequent fluid pressure is above the threshold fluid pressure, applying the subsequent fluid pressure physically decouples and fluidly couples the first piston 262 and the second piston 268. Accordingly, the pressure intensifier feature is activated at this time.

In one or more embodiments, the applying the initial fluid pressure below the threshold fluid pressure moves the sliding element 250 equal to or greater than 75% of the total setting stroke, and applying the subsequent fluid pressure above the threshold fluid pressure moves the sliding element 250 equal to or less than 25% of the total setting stroke. In yet another embodiment, the applying the initial fluid pressure below the threshold fluid pressure moves the sliding element 250 equal to or greater than 85% of the total setting stroke, and applying the subsequent fluid pressure above the threshold fluid pressure moves the sliding element 250 equal to or less than 15% of the total setting stroke. In even yet another embodiment, the applying the initial fluid pressure below the threshold fluid pressure moves the sliding element 250 equal to or greater than 95% of the total setting stroke, and applying the subsequent fluid pressure above the threshold fluid pressure moves the sliding element 250 equal to or less than 5% of the total setting stroke.

Turning now to FIGS. 3A through 3I, illustrated are different cross-sectional views of various deployment states of a downhole tool 300 designed, manufactured and/or operated according to one or more alternative embodiments of the disclosure. The downhole tool 300 of FIGS. 3A through 3I is similar in many respects to the downhole tool 200 of FIGS. 2A through 2I. Accordingly, like reference numbers have been used to indicate similar, if not identical, features. The downhole tool 300 differs, for the most part, from the downhole tool 200 in that the downhole tool 300 employs a shear feature 376, as compared to the collet 276 of FIGS. 2A through 2I, to set the threshold fluid pressure.

Turning now to FIGS. 4A through 4I, illustrated are different cross-sectional views of various deployment states of a downhole tool 400 designed, manufactured and/or operated according to one or more alternative embodiments of the disclosure. The downhole tool 400 of FIGS. 4A through 4I is similar in many respects to the downhole tool 200 of FIGS. 2A through 2I. Accordingly, like reference numbers have been used to indicate similar, if not identical, features. The downhole tool 400 differs, for the most part, from the downhole tool 200 in that the downhole tool 400 employs a burst disc 476, as compared to the collet 276 of FIGS. 2A through 2I, to set the threshold fluid pressure.

The downhole tool 400, in the illustrated embodiment, further includes a check valve 478 located in the fluid chamber 274. In accordance with this embodiment, the check valve 478 is configured to allow uncompressed fluid located within the fluid chamber 274 to move from the first pressure output end 266 of the first piston 262 toward the second pressure receiving end 270 of the second piston 268, and stop the uncompressed fluid located within the fluid chamber 274 from moving back from the second pressure receiving end 270 of the second piston 268 toward the first pressure output end 266 of the first piston 262. One skilled in the art would recognize that one or more embodiments may use a flow restrictor instead of a burst disk. In such a design, the pressure intensifier would be activated after a threshold time of applying the target input pressure. Initially, the flow restrictor stops pressure from building up in chamber 274 so both pistons move together. Over time, pressure makes it past the restrictor and builds up inside chamber 274 which will cause the pressure intensifier to activate as the pistons are now fluidically coupled. As a non-limiting example, suppose a pressure of 1,500 psi is applied for 15 minutes. For the first 10 minutes, the pistons move together for a majority of the total stroke and come to a stop as the pressure is still making its way past the restrictor and the load generated by the input pressure is not sufficient to actuate the element past a partially deployed state. After 10 minutes, the pressure starts to build up in chamber 274 to fluidically couple the first and second piston to activate the pressure intensifier. This results in the second piston applying the increased load on the element and moving for a minority of the total stroke over the remaining 5 minutes hence fully actuating the element.

Turning now to FIGS. 5A through 5R, illustrated are different cross-sectional views of various deployment states of a downhole tool 500 designed, manufactured and/or operated according to one or more alternative embodiments of the disclosure. The downhole tool 500 of FIGS. 5A through 5R is similar in many respects to the downhole tool 400 of FIGS. 4A through 4I. Accordingly, like reference numbers have been used to indicate similar, if not identical, features. The downhole tool 500 differs, for the most part, from the downhole tool 400 in that the downhole tool 500 is operating as a valve assembly. Accordingly, in the embodiment of FIGS. 5A through 5R, the sliding element 250 is coupled to a valve element 510 having a fluid passageway 520 therein. In one or more embodiments, the fluid passageway 520 of the valve element 510 is configured to misalign with an opening 530 in the mandrel 210, and thus shut the valve assembly, or alternatively at least partially align with the opening 530 in the mandrel 210, and thus open the valve assembly.

In the embodiment of FIGS. 5A through 5R, the pressure intensifier 260 may be used to dislodge the valve element 510 if it were to get stuck. For example, debris 540 might prevent the valve element 510 from appropriately opening and/or closing. Accordingly, the pressure intensifier 260 could be activated to force the valve element 510 past the debris. Thereafter, the user of the downhole tool 500 might reduce the pressure from the subsequent fluid pressure above the threshold pressure to a value below the threshold pressure, or alternatively could keep the higher subsequent fluid pressure.

The downhole tool 500, in the embodiment of FIGS. 5A through 5R, additionally includes a spring member 550 located in the fluid chamber 274. In accordance with one or more embodiments, the spring member 550 is configured to allow the pressure intensifier 260 to reset for repeated use, as shown in FIGS. 5A through 5R.

FIGS. 5A through 5C illustrate the downhole tool 500 in a run-in-hole state.

FIGS. 5D through 5F illustrate the downhole tool 500 of FIGS. 5A through 5C after applying an initial fluid 580 having an initial fluid pressure below the threshold fluid pressure to move the sliding element 250. In one or more embodiments, the initial fluid 580 is applied using a control line 560. As shown in FIGS. 5D through 5F, the sliding element 250 and/or the valve element 510 is stuck on the debris 540.

FIGS. 5G through 5I illustrate the downhole tool 500 of FIGS. 5D through 5F after applying a subsequent fluid 585 having a subsequent pressure above the threshold fluid pressure to activate the pressure intensifier 260.

FIGS. 5J through 5L illustrate the downhole tool 500 of FIGS. 5G through 5I after the pressure intensifier 260 has forced the sliding element 250 and/or valve element 510 past the debris 540.

FIGS. 5M through 50 illustrate the downhole tool of FIGS. 5J through 5L after applying a fluid 590 having a fluid pressure below the threshold fluid pressure. Accordingly, the spring member 550 allows the pressure intensifier 260 to reset for repeated use.

FIGS. 5P through 5R illustrate the downhole tool 500 of FIGS. 5M through 50 after the valve element 510 has moved its full setting stroke, and thus fluid passageway 520 in the valve element 510 aligns with the opening 530 in the mandrel 210, thereby opening the valve assembly.

Aspects disclosed herein include:

A. A downhole tool, the downhole tool including: 1) a mandrel; 2) a sliding element positioned radially about the mandrel; and 3) a pressure intensifier positioned radially about the mandrel and coupled to the sliding element, the pressure intensifier including: a) a first piston having a first pressure receiving end with a larger piston surface area ($A_{L1}$) and a first pressure output end with a smaller piston surface area ($A_S$); and b) a second piston coupled to the first piston, the second piston having a second pressure receiving end with a larger piston surface area ($A_{L2}$), a fluid chamber defined between the first pressure output end of the first piston with the smaller piston surface area ($A_S$) and the second pressure receiving end of the second piston with the larger piston surface area ($A_{L2}$), the pressure intensifier configured to move the sliding element when a force is applied thereto.

B. A well system, the well system including: 1) a wellbore located in a subterranean formation; and 2) a downhole tool positioned in the wellbore, the downhole tool including: a) a mandrel; b) a sliding element positioned radially about the mandrel; and c) a pressure intensifier positioned radially about the mandrel and coupled to the sliding element, the pressure intensifier including: i) a first piston having a first pressure receiving end with a larger piston surface area ($A_{L1}$) and a first pressure output end with a smaller piston surface area ($A_S$); and ii) a second piston coupled to the first piston, the second piston having a second pressure receiving end with a larger piston surface area ($A_{L2}$), a fluid chamber defined between the first pressure output end of the first piston with the smaller piston surface area ($A_S$) and the second pressure receiving end of the second piston with the larger piston surface area ($A_{L2}$), the pressure intensifier configured to move the sliding element when a force is applied thereto.

C. A method, the method including: 1) positioning a downhole tool in a wellbore located in a subterranean formation, the downhole tool including: a) a mandrel; b) a sliding element positioned radially about the mandrel; and c) a pressure intensifier positioned radially about the mandrel and coupled to the sliding element, the pressure intensifier including: i) a first piston having a first pressure receiving end with a larger piston surface area ($A_{L1}$) and a first pressure output end with a smaller piston surface area ($A_S$); and ii) a second piston coupled to the first piston, the second piston having a second pressure receiving end with a larger piston surface area ($A_{L2}$), a fluid chamber defined between the first pressure output end of the first piston with the smaller piston surface area ($A_S$) and the second pressure receiving end of the second piston with the larger piston surface area ($A_{L2}$), the pressure intensifier configured to move the sliding element when a force is applied thereto; and 2) applying fluid pressure to the pressure intensifier to move the sliding element.

Aspects A, B, and C may have one or more of the following additional elements in combination: Element 1: wherein the pressure intensifier is a selectively engageable pressure intensifier, the selectively engageable pressure intensifier configured to have an initial state physically coupling the first piston and the second piston with one another when subjected to an initial fluid pressure below a threshold fluid pressure, and configured to have a subsequent state physically decoupling and fluidly coupling the first piston and the second piston with one another when subjected to a subsequent fluid pressure above the threshold fluid pressure. Element 2: further including a collet feature, wherein the collet feature is configured to set the threshold fluid pressure, and thus remain engaged to physically couple the first piston and the second piston when the selectively engageable pressure intensifier is subjected to the initial fluid pressure below the threshold fluid pressure, and disengage to physically decouple and fluidly couple the first piston and the second piston when the selectively engageable pressure intensifier is subjected to the subsequent fluid pressure above the threshold fluid pressure. Element 3: further including a shear feature, wherein the shear feature is configured to set the threshold fluid pressure, and thus remain intact to physically couple the first piston and the second piston when the selectively engageable pressure intensifier is subjected to the initial fluid pressure below the threshold fluid pressure, and shear to physically decouple and fluidly couple the first piston and the second piston when the selectively engageable pressure intensifier is subjected to the subsequent fluid pressure above the threshold fluid pressure. Element 4: further including a burst disc located in the fluid chamber, wherein the burst disc is configured to set the threshold fluid pressure, and thus remain intact to physically couple the first piston and the second piston when the selectively engageable pressure intensifier is subjected to the initial fluid pressure below the threshold fluid pressure, and burst to physically decouple and fluidly couple the first piston and the second piston when the selectively engageable pressure intensifier is subjected to the subsequent fluid pressure above the threshold fluid pressure. Element 5: further including a check valve located in the fluid chamber, the check valve configured to allow uncompressed fluid located within the fluid chamber to move from the first pressure output end of the first piston toward the second pressure receiving end of the second piston and stop the uncompressed fluid located within the fluid chamber from moving back from the second pressure receiving end of the second piston toward the first pressure output end of the first piston. Element 6: wherein the pressure intensifier is a selectively engageable pressure intensifier, the selectively engageable pressure intensifier configured to have an initial state physically coupling the first piston and the second piston with one another for a duration of time, and configured to have a subsequent state physically decoupling and fluidly coupling the first piston and the second piston with one another after an amount of time has lapsed. Element 7: further including a flow restrictor located in the fluid chamber, wherein the flow restrictor is configured to set the threshold time, and thus remain intact to physically couple the first piston and the second piston when the selectively engageable pressure intensifier is subjected to applied pressure and physically decouple and fluidly couple the first piston and the second piston after a certain amount of time has lapsed. Element 8: further including a spring member located in the fluid chamber, the spring member configured to allow the pressure intensifier to reset for repeated use. Element 9: wherein the sliding element is coupled to a radially expanding sealing element, the sliding element configured to axially compress the radial expanding sealing element into radial engagement with an outer tubular as the pressure intensifier moves the sliding element when the force is applied thereto. Element 10: wherein the sliding element is coupled to a radially expanding anchor element, the sliding element configured to axially compress the radial expanding anchor element into radial engagement with an outer tubular as the pressure intensifier moves the sliding element when the force is applied thereto. Element 11: wherein the sliding element is coupled to a valve element, the sliding element configured to open or close a valve of the valve element as the pressure intensifier moves the sliding element when a force is applied thereto. Element 12: wherein the pressure intensifier is a selectively engageable pressure intensifier, the selectively engageable pressure intensifier configured to have an initial state physically coupling the first piston and the second piston with one another when subjected to an initial fluid pressure below a threshold fluid pressure, and configured to have a subsequent state physically decoupling and fluidly coupling the first piston and the second piston with one another when subjected to a subsequent fluid pressure above the threshold fluid pressure. Element 13: wherein the applying fluid pressure to the pressure intensifier to move the sliding element includes: 1) applying an initial fluid pressure below the threshold fluid pressure to move the sliding element a majority of a total setting stroke, the first piston and the second piston remaining physically coupled to one another while being subjected to this initial fluid pressure; and 2) applying a subsequent fluid pressure above the threshold fluid pressure to move the sliding element a remaining minority of the total setting stroke, the applying the subsequent fluid pressure physically decoupling and fluidly coupling the first piston and the second piston to activate the pressure intensifier. Element 14: wherein the applying the initial fluid pressure below the threshold fluid pressure moves the sliding element equal to or greater than 75% of the total setting stroke, and wherein applying the subsequent fluid pressure above the threshold fluid pressure moves the sliding element equal to or less than 25% of the total setting stroke. Element 15: wherein the applying the initial fluid pressure below the threshold fluid pressure moves the sliding element equal to or greater than 85% of the total setting stroke, and wherein applying the subsequent fluid pressure above the threshold fluid pressure moves the sliding element equal to or less than 15% of the total setting stroke. Element 16: wherein the applying the initial fluid pressure below the threshold fluid pressure moves the sliding element equal to or greater than 95% of the total setting stroke, and wherein applying the subsequent fluid pressure above the threshold fluid pressure moves the sliding element equal to or less than 5% of the total setting stroke. Element 17: wherein the pressure intensifier is a selectively engageable pressure intensifier, the selectively engageable pressure intensifier configured to have an initial state physically coupling the first piston and the second piston with one another for a duration of time, and configured to have a subsequent state physically decoupling and fluidly coupling the first piston and the second piston with one another when that duration of time has lapsed. Element 18: wherein the applying fluid pressure to the pressure intensifier to move the sliding element includes: applying fluid pressure and holding it for a duration of time resulting in the sliding element moving a majority of a total setting stroke, the first piston and the second piston remaining physically coupled to one another during this time, the pressure intensifier activating after a certain threshold time resulting in physically decoupling and fluidly coupling the first piston and the second piston to move the sliding element a remaining minority of the total setting stroke.

Those skilled in the art to which this application relates will appreciate that other and further additions, deletions, substitutions and modifications may be made to the described embodiments.

What is claimed is:

1. A downhole tool, comprising:

a mandrel;

a sliding element positioned radially about the mandrel; and a pressure intensifier positioned radially about the mandrel and coupled to the sliding element, the pressure intensifier including:

a first piston having a first pressure receiving end with a piston surface area ($A_{L1}$) and a first pressure output end with a smaller piston surface area ($A_S$);

a second piston coupled to the first piston, the second piston having a second pressure receiving end with a piston surface area ($A_{L2}$), a fluid chamber defined between the first pressure output end of the first piston with the smaller piston surface area ($A_S$) and the second pressure receiving end of the second piston with the piston surface area ($A_{L2}$), the pressure intensifier configured to move the sliding element when a force is applied thereto, wherein the pressure intensifier is a selectively engageable pressure intensifier, the selectively engageable pressure intensifier configured to have an initial state physically coupling the first piston and the second piston with one another when subjected to an initial fluid pressure below a threshold fluid pressure, and configured to have a subsequent state physically decoupling and fluidly coupling the first piston and the second piston with one another when subjected to a subsequent fluid pressure above the threshold fluid pressure, and a collet feature, wherein the collet feature is configured to set the threshold fluid pressure, and thus remain engaged to physically couple the first piston and the second piston when the selectively engageable pressure intensifier is subjected to the initial fluid pressure below the threshold fluid pressure, and disengage to physically decouple and fluidly couple the first piston and the second piston when the selectively engageable pressure intensifier is subjected to the subsequent fluid pressure above the threshold fluid pressure.

2. The downhole tool as recited in claim 1, further including a spring member located in the fluid chamber, the spring member configured to allow the pressure intensifier to reset for repeated use.

3. The downhole tool as recited in claim 1, wherein the sliding element is coupled to a radially expanding sealing element, the sliding element configured to axially compress the radial expanding sealing element into radial engagement with an outer tubular as the pressure intensifier moves the sliding element when the force is applied thereto.

4. The downhole tool as recited in claim 1, wherein the sliding element is coupled to a radially expanding anchor element, the sliding element configured to axially compress the radial expanding anchor element into radial engagement with an outer tubular as the pressure intensifier moves the sliding element when the force is applied thereto.

5. The downhole tool as recited in claim 1, wherein the sliding element is coupled to a valve element, the sliding element configured to open or close a valve of the valve element as the pressure intensifier moves the sliding element when a force is applied thereto.

6. A well system, comprising:

a wellbore located in a subterranean formation; and a downhole tool positioned in the wellbore, the downhole tool including:

a mandrel;

a sliding element positioned radially about the mandrel; and a pressure intensifier positioned radially about the mandrel and coupled to the sliding element, the pressure intensifier including:

a first piston having a first pressure receiving end with a piston surface area ($A_{L1}$) and a first pressure output end with a smaller piston surface area ($A_S$);

a second piston coupled to the first piston, the second piston having a second pressure receiving end with a piston surface area ($A_{L2}$), a fluid chamber defined between the first pressure output end of the first piston with the smaller piston surface area ($A_S$) and the second pressure receiving end of the second piston with the piston surface area ($A_{L2}$), the pressure intensifier configured to move the sliding element when a force is applied thereto, wherein the pressure intensifier is a selectively engageable pressure intensifier, the selectively engageable pressure intensifier configured to have an initial state physically coupling the first piston and the second piston with one another when subjected to an initial fluid pressure below a threshold fluid pressure, and configured to have a subsequent state physically decoupling and fluidly coupling the first piston and the second piston with one another when subjected to a subsequent fluid pressure above the threshold fluid pressure, and a collet feature, wherein the collet feature is configured to set the threshold fluid pressure, and thus remain engaged to physically couple the first piston and the second piston when the selectively engageable pressure intensifier is subjected to the initial fluid pressure below the threshold fluid pressure, and disengage to physically decouple and fluidly couple the first piston and the second piston when the selectively engageable pressure intensifier is subjected to the subsequent fluid pressure above the threshold fluid pressure.

7. The well system as recited in claim 6, further including a spring member located in the fluid chamber, the spring member configured to allow the pressure intensifier to reset for repeated use.

8. The well system as recited in claim 6, wherein the sliding element is coupled to a radially expanding sealing element, the sliding element configured to axially compress the radial expanding sealing element into radial engagement with an outer tubular as the pressure intensifier moves the sliding element when the force is applied thereto.

9. The well system as recited in claim 6, wherein the sliding element is coupled to a radially expanding anchor element, the sliding element configured to axially compress the radial expanding anchor element into radial engagement with an outer tubular as the pressure intensifier moves the sliding element when the force is applied thereto.

10. The well system as recited in claim 6, wherein the sliding element is coupled to a valve element, the sliding element configured to open or close a valve of the valve element as the pressure intensifier moves the sliding element when a force is applied thereto.

11. A method, comprising:

positioning a downhole tool in a wellbore located in a subterranean formation, the downhole tool including:

a mandrel;

a sliding element positioned radially about the mandrel; and a pressure intensifier positioned radially about the mandrel and coupled to the sliding element, the pressure intensifier including:

a first piston having a first pressure receiving end with a piston surface area ($A_{L1}$) and a first pressure output end with a smaller piston surface area ($A_S$);

a second piston coupled to the first piston, the second piston having a second pressure receiving end with a piston surface area ($A_{L2}$), a fluid chamber defined between the first pressure output end of the first piston with the smaller piston surface area ($A_S$) and the second pressure receiving end of the second piston with the piston surface area ($A_{L2}$), the pressure intensifier configured to move the sliding element when a force is applied thereto, wherein the pressure intensifier is a selectively engageable pressure intensifier, the selectively engageable pressure intensifier configured to have an initial state physically coupling the first piston and the second piston with one another when subjected to an initial fluid pressure below a threshold fluid pressure, and configured to have a subsequent state physically decoupling and fluidly coupling the first piston and the second piston with one another when subjected to a subsequent fluid pressure above the threshold fluid pressure; and a collet feature, wherein the collet feature is configured to set the threshold fluid pressure, and thus remain engaged to physically couple the first piston and the second piston when the selectively engageable pressure intensifier is subjected to the initial fluid pressure below the threshold fluid pressure, and disengage to physically decouple and fluidly couple the first piston and the second piston when the selectively engageable pressure intensifier is subjected to the subsequent fluid pressure above the threshold fluid pressure; and applying fluid pressure to the pressure intensifier to move the sliding element.

12. The method as recited in claim 11, wherein the applying fluid pressure to the pressure intensifier to move the sliding element includes:

applying an initial fluid pressure below the threshold fluid pressure to move the sliding element a majority of a total setting stroke, the first piston and the second piston remaining physically coupled to one another while being subjected to this initial fluid pressure; and applying a subsequent fluid pressure above the threshold fluid pressure to move the sliding element a remaining minority of the total setting stroke, the applying the subsequent fluid pressure physically decoupling and fluidly coupling the first piston and the second piston to activate the pressure intensifier.

13. The method as recited in claim 12, wherein the applying the initial fluid pressure below the threshold fluid pressure moves the sliding element equal to or greater than 75% of the total setting stroke, and wherein applying the subsequent fluid pressure above the threshold fluid pressure moves the sliding element equal to or less than 25% of the total setting stroke.

14. The method as recited in claim 12, wherein the applying the initial fluid pressure below the threshold fluid pressure moves the sliding element equal to or greater than 85% of the total setting stroke, and wherein applying the subsequent fluid pressure above the threshold fluid pressure moves the sliding element equal to or less than 15% of the total setting stroke.

15. The method as recited in claim 12, wherein the applying the initial fluid pressure below the threshold fluid pressure moves the sliding element equal to or greater than 95% of the total setting stroke, and wherein applying the subsequent fluid pressure above the threshold fluid pressure moves the sliding element equal to or less than 5% of the total setting stroke.

16. The method as recited in claim 11, wherein the pressure intensifier is a selectively engageable pressure intensifier, the selectively engageable pressure intensifier configured to have an initial state physically coupling the first piston and the second piston with one another for a duration of time, and configured to have a subsequent state physically decoupling and fluidly coupling the first piston and the second piston with one another when that duration of time has lapsed.

17. The method as recited in claim 16, wherein the applying fluid pressure to the pressure intensifier to move the sliding element includes:

applying fluid pressure and holding it for a duration of time resulting in the sliding element moving a majority of a total setting stroke, the first piston and the second piston remaining physically coupled to one another during this time, the pressure intensifier activating after a certain threshold time resulting in physically decoupling and fluidly coupling the first piston and the second piston to move the sliding element a remaining minority of the total setting stroke.

* * * * *